US009542797B2

(12) United States Patent
Detlefsen et al.

(10) Patent No.: US 9,542,797 B2
(45) Date of Patent: Jan. 10, 2017

(54) GAMING SYSTEM WITH REMOTE CONTROLLER HAVING LOCATION-BASED VARIABLE FUNCTIONALITY

(71) Applicant: WMS Gaming Inc., Waukegan, IL (US)

(72) Inventors: David E. Detlefsen, Northfield, IL (US); Mark B. Gagner, West Chicago, IL (US); Paul M. Lesley, Blue Island, IL (US); Timothy C. Loose, Chicago, IL (US); Scott A. Massing, Lincolnwood, IL (US); Larry J. Pacey, Chicago, IL (US); Craig J. Sylla, Round Lake, IL (US); Matthew J. Ward, Northbrook, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 232 days.

(21) Appl. No.: 13/767,093

(22) Filed: Feb. 14, 2013

(65) Prior Publication Data

US 2014/0228096 A1 Aug. 14, 2014

(51) Int. Cl.
*G07F 17/32* (2006.01)

(52) U.S. Cl.
CPC ..... *G07F 17/3218* (2013.01); *G07F 17/3209* (2013.01)

(58) Field of Classification Search
CPC ..... A63F 9/24; A63F 13/06; A63F 13/02; A63F 13/12; G07F 17/32; G07F 17/3204; G07F 17/3209; G07F 17/3218
See application file for complete search history.

(56) References Cited

U.S. PATENT DOCUMENTS

| | | | | |
|---|---|---|---|---|
| 4,805,907 | A | 2/1989 | Hagiwara | |
| 5,669,817 | A | 9/1997 | Tarantino | |
| 6,270,410 | B1 * | 8/2001 | DeMar et al. | 463/20 |
| 6,319,125 | B1 | 11/2001 | Acres | |
| 6,358,149 | B1 | 3/2002 | Schneider et al. | |
| 6,517,433 | B2 | 2/2003 | Loose et al. | |
| 6,638,166 | B2 * | 10/2003 | Hedrick et al. | 463/20 |
| 6,801,231 | B1 * | 10/2004 | Beltz | 715/865 |
| 6,966,837 | B1 | 11/2005 | Best | |

(Continued)

FOREIGN PATENT DOCUMENTS

| | | |
|---|---|---|
| WO | 2007/030675 | 3/2007 |
| WO | 2007/047977 | 4/2007 |

(Continued)

*Primary Examiner* — Jason Skaarup
(74) *Attorney, Agent, or Firm* — Nixon Peabody LLP

(57) ABSTRACT

A gaming system includes a handheld device coupled to a fixed structure. The handheld device includes a sensor configured to detect inputs. The handheld device is positionable in a base predefined zone and a first predefined zone. The base predefined zone is defined as a base volumetric space and the first predefined zone is defined as a first volumetric space. A memory device stores instructions that, when executed, by at least one of one or more processors of the gaming system, cause the gaming system to (i) detect a first input from the handheld device, (ii) perform a first function in response to the first input being detected in the base predefined zone, and (iii) perform a second function in response to the first input being detected in the first predefined zone, the second function being different from the first function.

22 Claims, 13 Drawing Sheets

(56) References Cited

U.S. PATENT DOCUMENTS

| | | | | |
|---|---|---|---|---|
| 7,326,117 | B1 | 2/2008 | Best | |
| 7,662,040 | B2 | 2/2010 | Englman et al. | |
| 7,780,531 | B2 | 8/2010 | Englman et al. | |
| 7,833,094 | B2 | 11/2010 | Englman et al. | |
| 8,057,294 | B2 | 11/2011 | Pacey et al. | |
| 8,057,295 | B2 | 11/2011 | Vann et al. | |
| 8,092,297 | B2 | 1/2012 | Decasa et al. | |
| 8,109,821 | B2 | 2/2012 | Kovacs et al. | |
| 8,241,127 | B2 * | 8/2012 | Kovacs | 463/39 |
| 8,419,549 | B2 | 4/2013 | Kaminkow | |
| 8,574,079 | B2 * | 11/2013 | Russell | 463/39 |
| 2002/0123381 | A1 * | 9/2002 | Akeripa | 463/36 |
| 2003/0119581 | A1 | 6/2003 | Cannon et al. | |
| 2003/0148804 | A1 | 8/2003 | Ikeya et al. | |
| 2004/0140617 | A1 * | 7/2004 | Cordell | 273/292 |
| 2005/0014554 | A1 * | 1/2005 | Walker et al. | 463/20 |
| 2006/0287086 | A1 * | 12/2006 | Zalewski et al. | 463/37 |
| 2008/0096659 | A1 * | 4/2008 | Kreloff et al. | 463/39 |
| 2009/0093298 | A1 | 4/2009 | Michel | |
| 2010/0041464 | A1 | 2/2010 | Arezina et al. | |
| 2010/0069160 | A1 | 3/2010 | Barrett et al. | |
| 2010/0222123 | A1 | 9/2010 | Hornik | |
| 2010/0234090 | A1 | 9/2010 | Thomas | |
| 2010/0234099 | A1 | 9/2010 | Rasmussen et al. | |
| 2010/0267439 | A1 | 10/2010 | Englman et al. | |
| 2010/0279764 | A1 | 11/2010 | Alien et al. | |
| 2010/0317424 | A1 | 12/2010 | Hornik et al. | |
| 2010/0317442 | A1 | 12/2010 | Thomas et al. | |
| 2011/0034239 | A1 | 2/2011 | Collette et al. | |
| 2011/0065495 | A1 | 3/2011 | Hornik et al. | |
| 2011/0070940 | A1 | 3/2011 | Jaffe et al. | |
| 2011/0105233 | A1 | 5/2011 | Aoki | |
| 2011/0128228 | A1 * | 6/2011 | Van der Byl | G06F 1/1624 345/167 |
| 2011/0130192 | A1 | 6/2011 | Englman et al. | |
| 2011/0300926 | A1 | 12/2011 | Englman et al. | |
| 2013/0090166 | A1 * | 4/2013 | Mao et al. | 463/39 |
| 2014/0179397 | A1 * | 6/2014 | Thompson et al. | 463/20 |
| 2014/0179413 | A1 * | 6/2014 | Thompson | G07F 17/3206 463/25 |

FOREIGN PATENT DOCUMENTS

| | | |
|---|---|---|
| WO | 2008/045398 | 4/2008 |
| WO | 2008/133850 | 11/2008 |
| WO | 2009/061383 | 5/2009 |
| WO | 2011/139716 | 11/2011 |

* cited by examiner

FIG. 6B
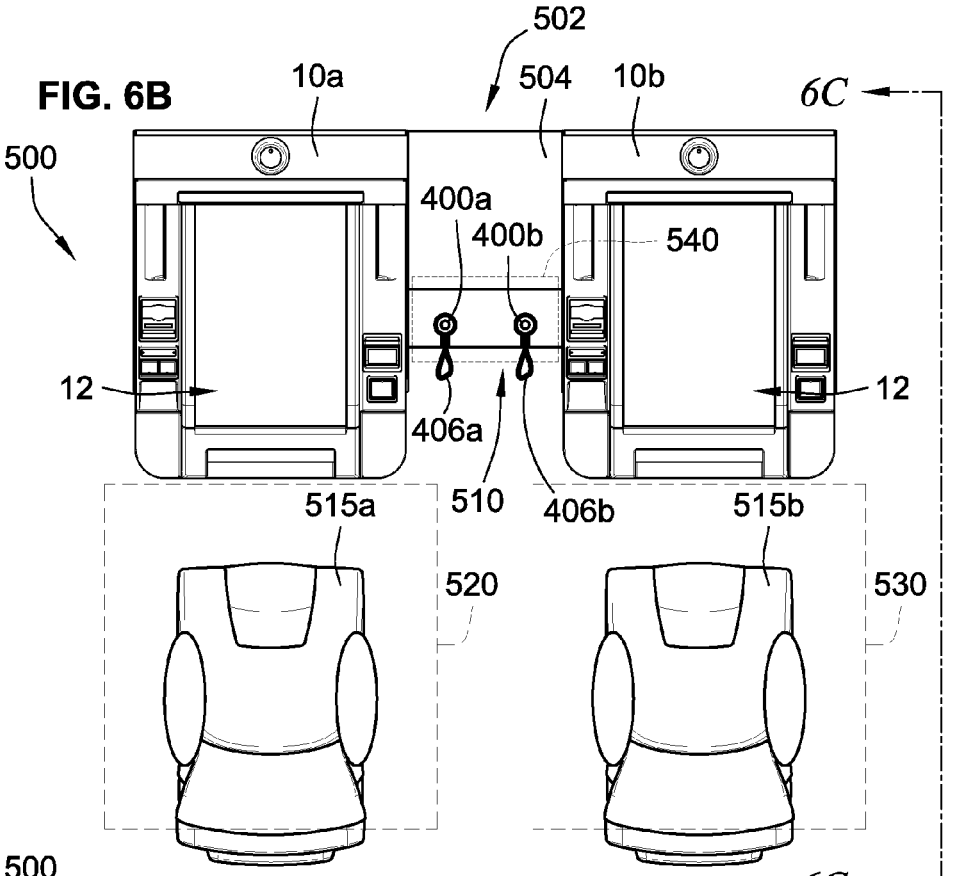
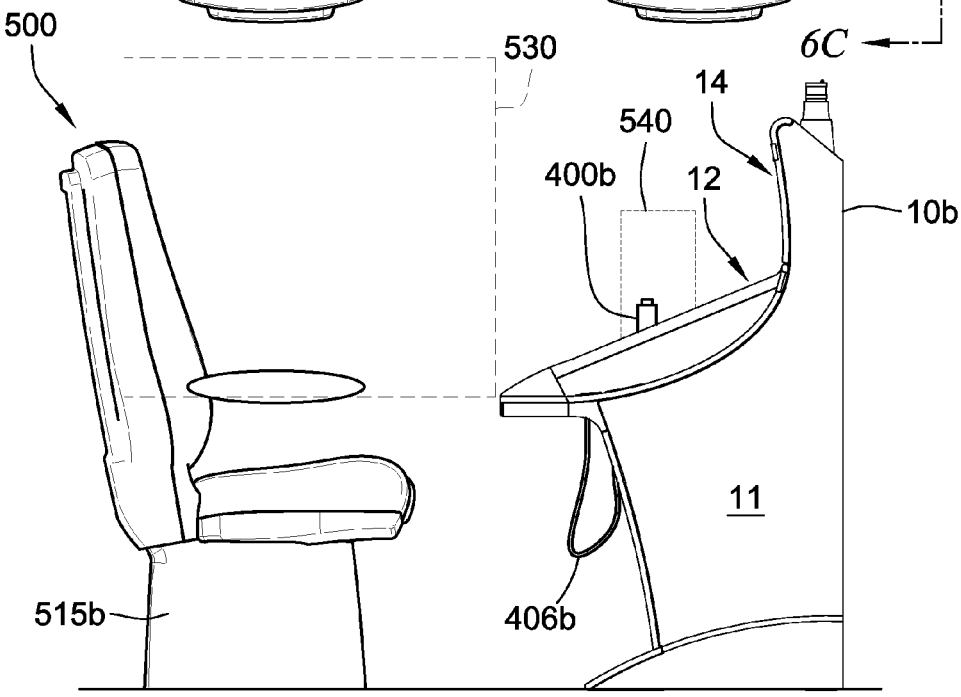
FIG. 6C

GAMING SYSTEM WITH REMOTE CONTROLLER HAVING LOCATION-BASED VARIABLE FUNCTIONALITY

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and methods for playing wagering games, and more particularly, to a gaming system with a remote controller having location-based variable functionality.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to an aspect of the present disclosure, a gaming system includes a fixed structure, one or more display devices, one or more processors, a handheld device, and a memory device. The handheld device is coupled to the fixed structure via a cable. The handheld device includes a sensor configured to detect inputs. The handheld device is positionable in a first predefined zone and a base predefined zone with respect to the fixed structure. The first predefined zone is defined as a first volumetric space generally in front of the one or more display devices. The base predefined zone is defined as a base volumetric space generally in front of the fixed structure distinct from the first predefined zone. The memory device stores instructions that, when executed by at least one of the one or more processors cause the gaming system to (i) detect a first input from the handheld device, (ii) perform a first function in response to the first input being detected in the first predefined zone, and (iii) perform a second function in response to the first input being detected in the base predefined zone, the second function being different from the first function.

According to an aspect of the present disclosure, a community gaming system includes a first gaming terminal, a second gaming terminal, a fixed structure, a first handheld device, and a second handheld device. The first gaming terminal includes one or more first display devices for displaying plays of a wagering game. The second gaming terminal is adjacent to the first gaming terminal and includes one or more second display devices displaying plays of a wagering game. The fixed structure is positioned between the first and the second gaming terminals. The first handheld device is coupled to the fixed structure via a first cable. The first handheld device includes a first sensor configured to detect inputs. The first handheld device is positionable in a first predefined zone and a base predefined zone. The first predefined zone is defined as a first volumetric space generally in front of the one or more first display devices. The base predefined zone is defined as a base volumetric space generally in front of the fixed structure distinct from the first predefined zone. The first handheld device is configured to be calibrated for use in playing a wagering game on the first gaming terminal or on the second gaming terminal. The second handheld device is coupled to the fixed structure via a second cable. The second handheld device includes a second sensor configured to detect inputs. The second handheld device is positionable in a second predefined zone and the base predefined zone. The second predefined zone is defined as a second volumetric space generally in front of the one or more second display devices distinct from the first and the base predefined zones. The second handheld device is configured to be calibrated for use in playing a wagering game on the other of the first gaming terminal and the second gaming terminal.

According to an aspect of the present disclosure, a method of calibrating a handheld device coupled to a wagering game system for use in conducting a wagering game displayed on one or more display devices of the wagering game system includes coupling the handheld device to a docking station of a fixed structure of the wagering game system such that the handheld device is positioned in a base predefined zone of a base volumetric space about the fixed structure when coupled to the docking station. The handheld device includes a sensor. A first input is detected using the sensor. The handheld device is decoupled from the docking station. The handheld device is positioned in a first predefined zone of a first volumetric space that is distinct from the base predefined zone. The first predefined zone is adjacent to a display device of a first gaming terminal of the wagering game system. A second input is detected using the sensor. In response to detecting the second input, the handheld device is associated with the first gaming terminal.

According to an aspect of the present disclosure, a method of calibrating a handheld device coupled to a gaming terminal of a wagering game system for use in conducting a wagering game displayed on one or more display devices of the gaming terminal includes coupling the handheld device to a docking station of a fixed structure of the wagering game system such that the handheld device is positioned in a base predefined zone of a base volumetric space about the fixed structure when coupled to the docking station. The handheld device includes a sensor. A first input is detected using the sensor. The handheld device is decoupled from the docking station. The handheld device is positioned in a first zone of a first volumetric space that is distinct from the base predefined zone. The first zone is adjacent to at least one of the one or more display devices of the gaming terminal. A second input is detected using the sensor. The first zone is defined in the first volumetric space based on the position of the handheld device in response to the sensor detecting the second input.

According to an aspect of the present disclosure, a gaming system includes a fixed structure, one or more display devices, one or more processors, a handheld device, and a memory device. The handheld device is coupled to the fixed structure via a cable. The handheld device is moveable in a predefined zone of a volumetric space adjacent to at least one of the one or more display devices. The memory device stores instructions that, when executed by at least one of the one or more processors cause the gaming system to (i) display, on at least one of the one or more display devices, at least a portion of a wagering game including a plurality of selectable bonus elements, (ii) perform a first function in response to the handheld device being located adjacent to a first one of the plurality of selectable bonus elements, and (iii) perform a second function, that is distinct from the first function, in response to the handheld device being located adjacent to a second one of the plurality of selectable bonus elements.

Additional aspects of the present disclosure will be apparent to those of ordinary skill in the art in view of the detailed description of various implementations, which is made with reference to the drawings, a brief description of which is provided below.

BRIEF DESCRIPTION OF THE DRAWINGS

FIG. 6B is a top view of the gaming system of FIG. 6A;

FIG. 6C is a side elevation view of the gaming system of FIG. 6A;

Figure 1:
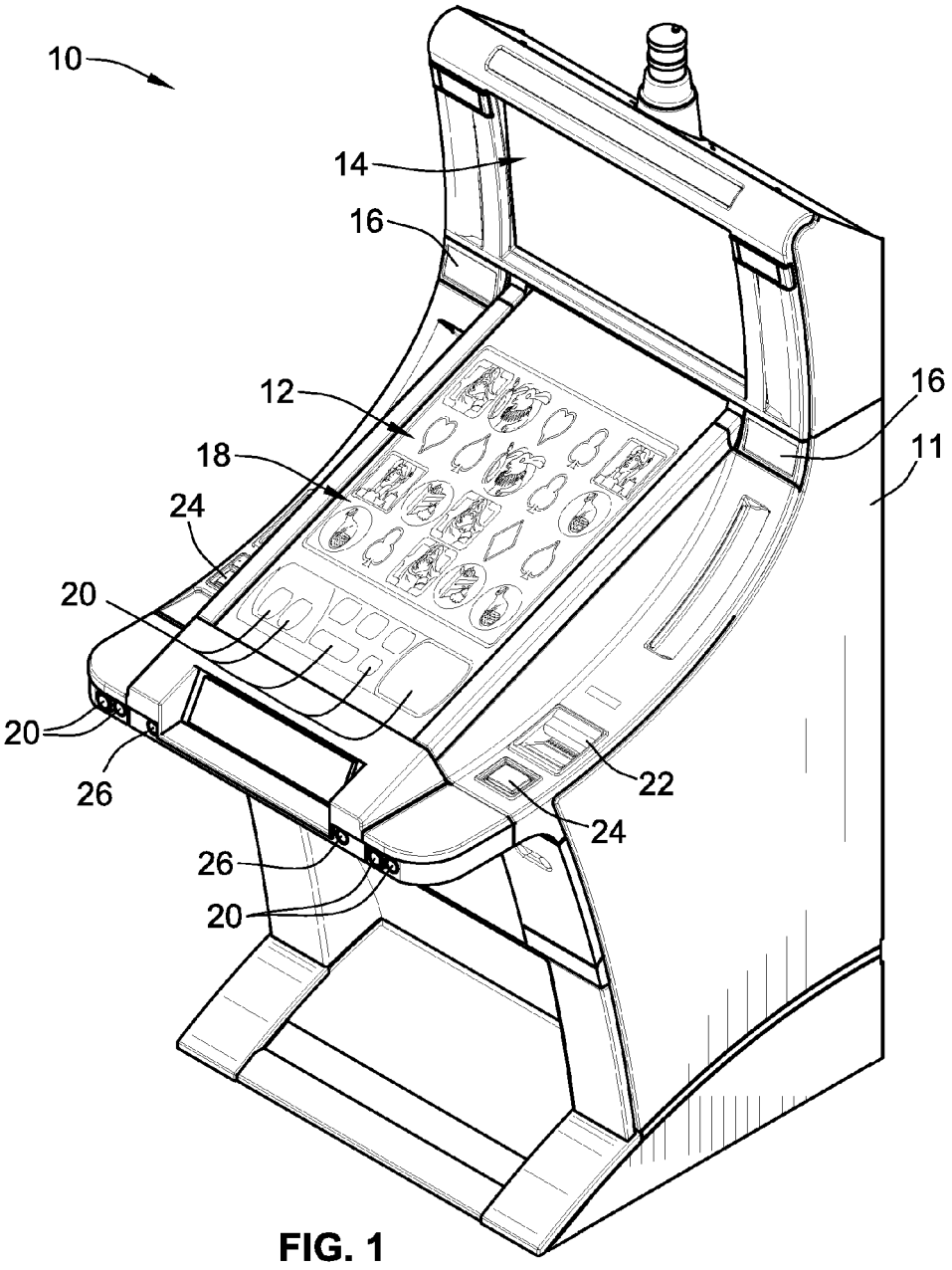
FIG. 1 is a perspective view of a free-standing gaming terminal according to some implementations of the present disclosure.

While the present disclosure is susceptible to various modifications and alternative forms, specific embodiments and/or implementations have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

While this present disclosure is susceptible of implementation in many different forms, there is shown in the drawings and will herein be described in detail preferred implementations of the present disclosure with the understanding that the present disclosure is to be considered as an exemplification of the principles of the invention and is not intended to limit the broad aspect of the invention to the implementations illustrated. For purposes of the present detailed description, the singular includes the plural and vice versa (unless specifically disclaimed); the word "or" shall be both conjunctive and disjunctive such that A "or" B shall mean A only, B only, or A and B; the word "all" means "any and all"; the word "any" means "any and all"; and the word "including" means "including without limitation." The article "a" or "an," unless explicitly stated otherwise, shall mean "at least one" or "one or more." There is no difference in meaning among the terms "one or more," "at least one," "a," or "an." Reference numbers that include letter suffixes refer to like components or modules and can be referred generally by their numerical reference (without a letter suffix) to refer to any combination or all of the like components or modules to which the reference numbers with letter suffixes refer.

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos.

US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
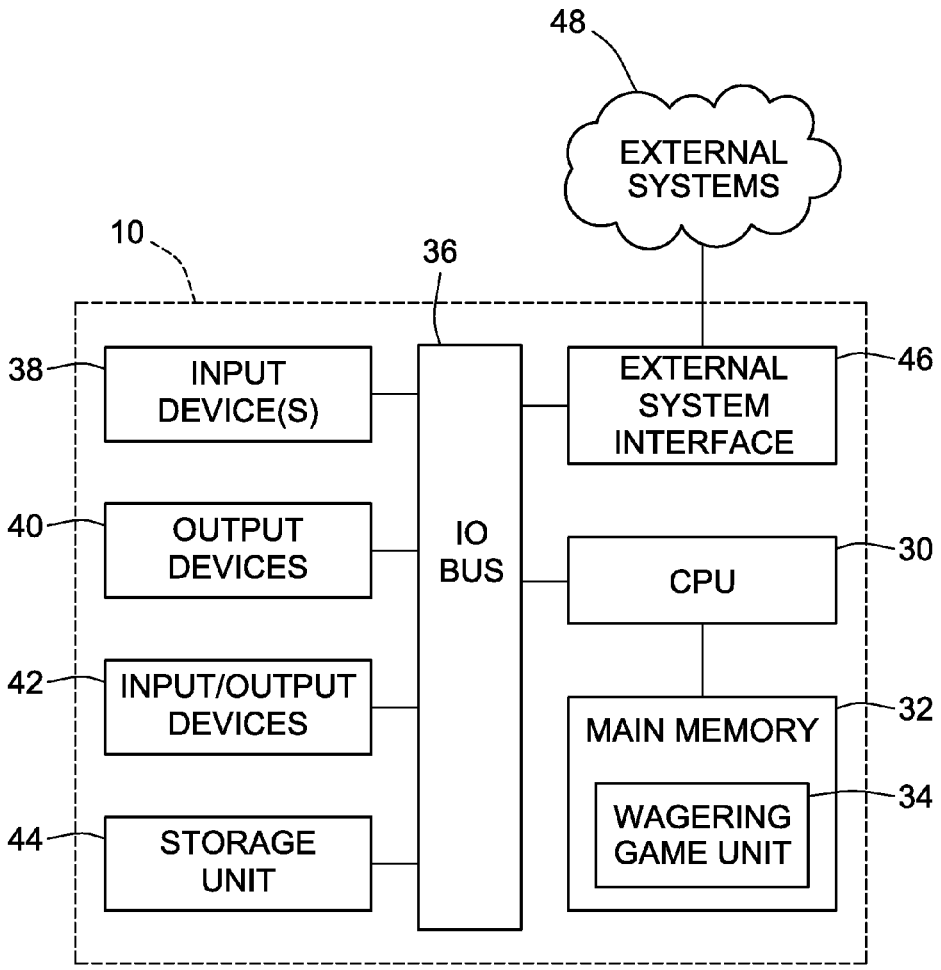
FIG. 2 is a schematic view of a gaming system according to some implementations of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
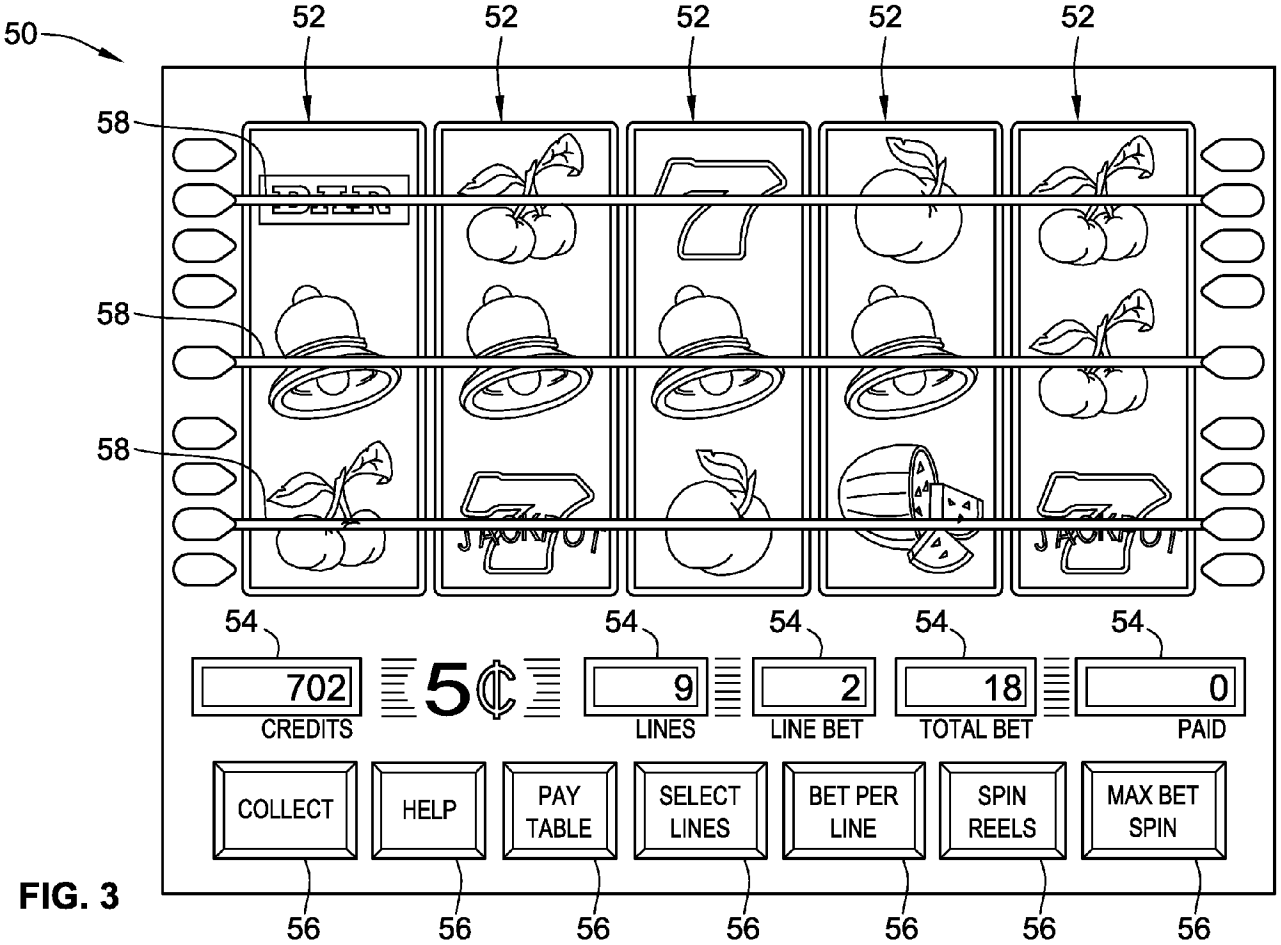
FIG. 3 is an image of an exemplary basic wagering game screen of a wagering game displayed on a gaming terminal, according to some implementations of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display area 12 or secondary display area 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein.

The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
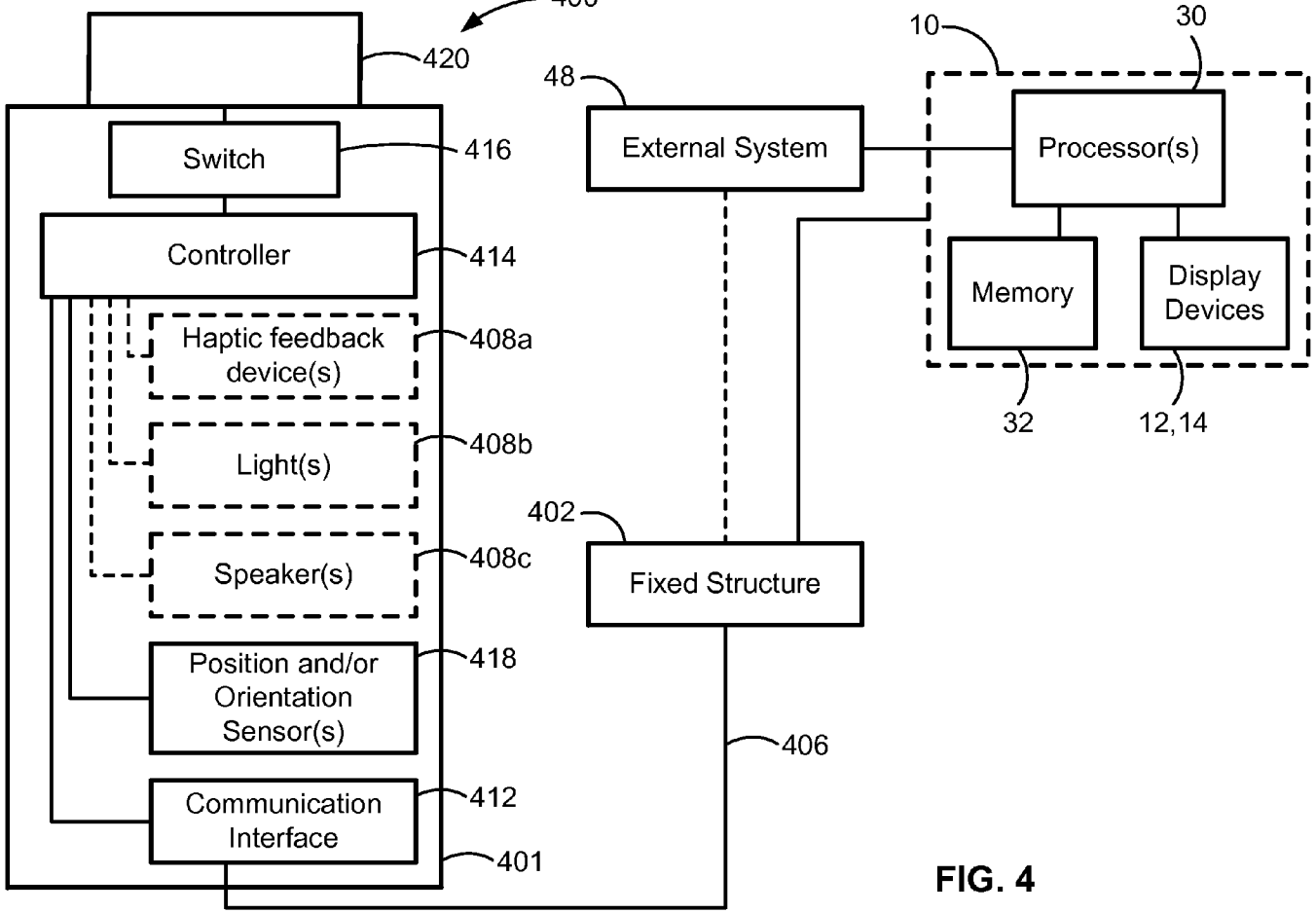
FIG. 4 is a functional block diagram of an example gaming system including a handheld device connected to a fixed structure by a cable according to some implementations of the present disclosure.

Referring now to FIG. 4, a functional block diagram of an example gaming terminal 10 coupled to a handheld device 400 (e.g., a remote, a remote controller, a wand, etc.) is shown according to aspects of the present disclosure. The handheld device 400 has a size and a weight sufficient to be held in or grasped by an average adult human's (left or right) hand. While the present disclosure is not intended to be limited to any specific form factor, the handheld device 400 can be cylindrical-shaped (e.g., FIG. 5) such as wand-shaped or have a round portion that can be grasped, such as shown in the figures that follow. However, it should be emphasized that these form factors are merely exemplary of the many form factors that can be made to be readily grasped or held by a human's hand. The reference number 400 shall be used herein to refer to any handheld device described herein.

As shown in FIG. 4, the handheld device 400 is connected to a fixed structure 402 by a cable 406. The fixed structure 402 can be any structure such as an anchor that allows the cable 406 to be in tension or relaxed relative thereto. Examples of these fixed structures will be described below, and include a frame or other fixed structure such as within the cabinet 11 of a gaming terminal like the gaming terminal 10 or adjacent thereto. The cable 406 can include one or more conductors and/or optical fibers, one, some, or none of which can carry power and/or data signals between the handheld device 400 and other components of the gaming terminal 10 or the external system 48. In its most basic form, the cable 406 can be a tethering device, conductive or non-conductive, that prevents the handheld device 400 from being readily untethered from the gaming system (e.g., the gaming terminal 10) with which it is associated. In implementations in which data is communicated over wires between the handheld device 400 and the gaming terminal 10 and/or the external system 48, the cable 406 can be configured to carry data or power or both data and power via one or more conductors and/or optical fibers of the cable 406. Alternately, the data and/or power signals can be carried over conductors that are separate from the cable 406 and accessible from a connector port on the gaming terminal 10, for example.

The handheld device 400 includes one or more buttons 420, which can be one or more pushbuttons coupled to one or more switches 416 that indicate a state of the one or more buttons 420 (e.g., pressed or unpressed). That is, a single switch 416 can be coupled to multiple buttons 420 or each button 420 can be coupled to a respective switch 416. The switch 416 can output or provide a signal indicating the state of the button to a controller 414, which can communicate the button status information to a communications interface 412. The communications interface 412 can include a wired connector or a wireless transceiver configured to connect one or more conductors that communicate data between the handheld device 400 and other components in the gaming terminal 10 and/or external system 48. The cable 406 can be configured to include a conductor that carries data between the communications interface 412 of the handheld device 400 and the one or more processors 30.

In addition to, or in lieu of, the button 420 and the switch 416, the handheld device 400 includes one or more position and/or orientation sensors 418 (e.g., an inertial measurement unit/inertial sensor, or IMU, an optical measurement unit/optical sensor, a magnetic measurement unit/magnetic sensor, etc.) that detects a position (relative and/or absolute) and an orientation (relative and/or absolute) of the handheld device 400 and provides position and/or orientation data—indicative of the position and/or the orientation of the handheld device 400—to the controller 414, which in turn communicates, via the communications interface 412, the position data and/or the orientation data to the one or more processors 30.

The handheld device 400 can include a pressure-sensitive pad (not shown) to detect a pressure applied by a hand grasping the handheld device 400, and the pressure-sensitive pad communicates pressure information to the controller 414 indicative of a level of pressure applied to the pressure-sensitive pad. This pressure information can be used as an input to a wagering game conducted on the gaming terminal 10, such as, for example, selecting a graphic or symbol of the wagering game. For example, in a wagering game featuring a pick field comprising an array or arrangement of elements or symbols, each associated with a randomly determined outcome of the wagering game, the pressure information can be used to select the elements or the symbols, or they can be selected by the button 420 of the handheld device 400, or by a predetermined movement of the handheld device 400.

Still referring to FIG. 4, the handheld device 400 can further include one or more haptic feedback devices 408*a* (e.g., vibration mechanism), one or more lights 408*b*, one or more audio speakers 408*c*, or any combinations thereof, which are coupled to the controller 414. For convenience, although there can be multiple haptic feedback devices 408*a*, multiple lights 408*b*, and/or multiple audio speakers 408*c*, the singular form shall be used except in implementations that require multiple haptic feedback devices 408*a*, multiple lights 408*b*, and/or multiple audio speakers 408*c*.

The haptic feedback device 408*a* can be positioned anywhere within a housing 401 of the handheld device 400. The haptic feedback device 408*a* is coupled to the one or more processors 30 via the controller 414 and the communications interface 412, which is configured to cause the haptic feedback device 408*a* to impart haptic feedback that is transmitted to the housing 401 of the handheld device 400.

The light 408*b* can be positioned anywhere within the handheld device 400 such that at least a portion of the light 408*b* is visible external to the housing 401. The light 408*b* is coupled to the one or more processors 30 via the controller 414 and the communications interface 412, which is configured to cause the light 408*b* to emit light according to one or more blinking/flashing patterns. The emitted light can be any color (e.g., white, red, blue, green, yellow, amber, etc.). The light 408*b* can include a color lens over a white bulb. Alternatively, the light 408*b* can be configured to emit colored light without using a color lens.

The one or more blinking/flashing patterns can be random and/or correspond to one or more haptic feedback patterns imparted to the housing 401 by the haptic feedback device 408*a*. That is, for example, the haptic feedback device 408*a* can cause the housing 401 to vibrate according to a first pattern (e.g., vibrate for one second, then stop vibrating for one second, repeated five times) and the light 408*b* can emit light according to the same first pattern (e.g., emit light for one second, then stop emitting light for one second, repeated five times), a similar pattern, and/or a different pattern.

The audio speaker 408*c* can be positioned anywhere within the handheld device 400 such that sound emitted from the audio speaker 408*c* is audible external to the housing 401 (e.g., to a player of the wagering game conducted on the gaming terminal 10 using the handheld device 400). The audio speaker 408*c* is coupled to the one or more processors 30 via the controller 414 and the communications interface 412, which is configured to cause the audio speakers 408*c* to emit sound. The emitted sound can include one or more prerecorded audio clips. The prerecorded audio clips can be stored in the main memory 32 of the gaming terminal 10, in a memory (not shown) of the fixed structure 402, in a memory (not shown) of the external systems 48, in a memory (not shown) of the handheld device 400 itself, or any combinations thereof.

In all of these aspects, the handheld device 400 is an input device (e.g., a remote controller) that affects one or more graphics displayed on the display devices 12 or 14. In some implementations, the handheld device 400 affects one or more graphics displayed on one or both of the display devices 12, 14 based on a location of the handheld device 400 (e.g., the handheld device 400 has functionality based on its location). Various exemplary graphical user interfaces between the handheld device 400 and graphics displayed on the display devices 12 or 14 are described below.

Figure 5:
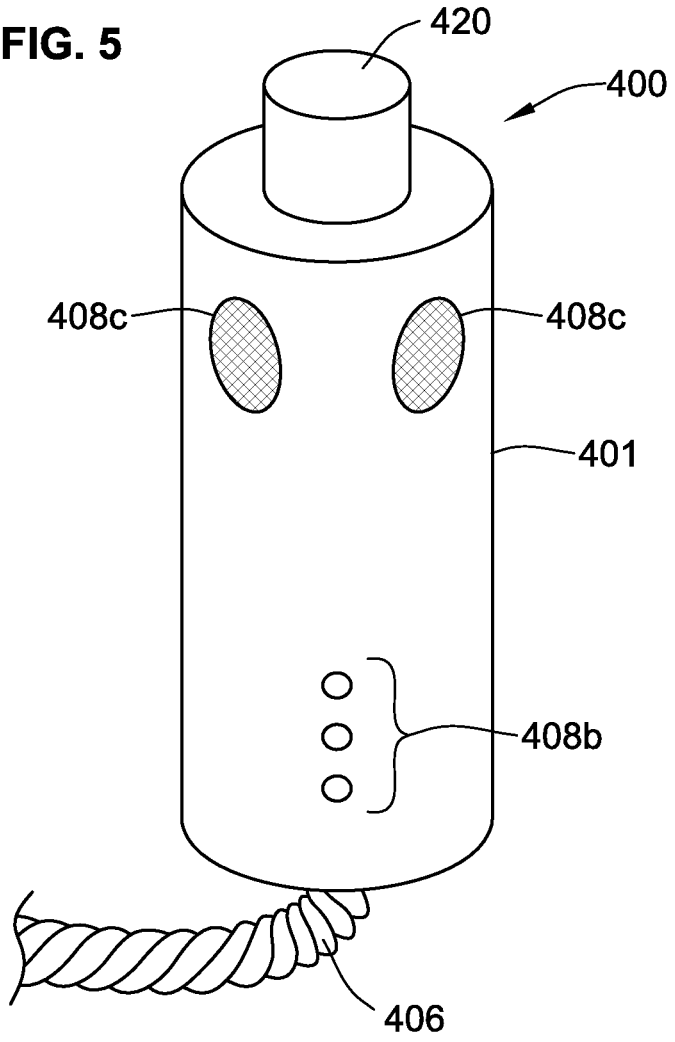
FIG. 5 is a perspective view of an example of a handheld device shown in FIG. 4.

FIG. 5 illustrates an exemplary form factor of the handheld device 400 having the button 420 on a top of the housing 401 and the cable 406 extending away from a bottom of the housing 401 of the handheld device 400. In this illustration, the handheld device 400 has an elongated cylindrical form of sufficient length to allow the handheld device 400 to be grasped by an average adult human hand. As shown, the handheld device 400 includes the optional lights 408*b* and the optional audio speakers 408*c*.

Figure 6A:
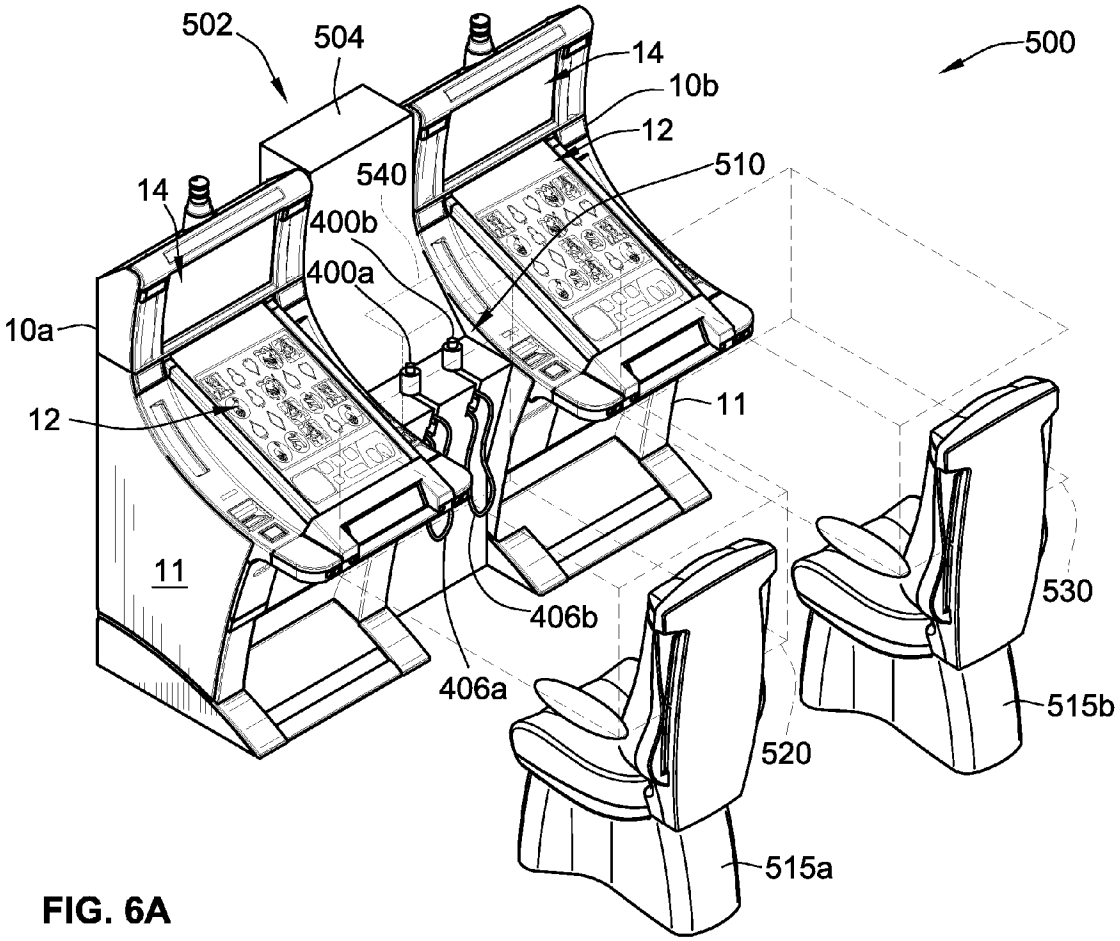
FIG. 6A is a perspective view of a gaming system including two gaming terminals separated by a spacer to which two handheld devices are tethered by respective cables according to some implementations of the present disclosure.

Now generally referring to FIGS. 6A-6C, an example configuration of a gaming system 500 (e.g., a community gaming system) is shown with two gaming terminals 10*a,b* side by side and separated by a spacer 502 (e.g., the fixed structure 402). The spacer 502 has a housing 504 that is distinct from the cabinets 11 of the gaming terminals 10*a,b*. Two handheld devices 400*a,b* (the same as, or similar to, the handheld device 400) are coupled to the spacer 502 via respective cables 406*a,b*. This configuration of the gaming system 500 allows the gaming terminals 10*a,b* to share the spacer 502—including the handheld devices 400*a,b*—without having to retrofit or modify existing gaming terminals 10. While not shown, the gaming system 500 can further include one or more community display devices positioned generally above the gaming terminals 10*a,b* for use in conducting community portions of the wagering game and/or displaying other items of information (e.g., advertisements, etc.).

The spacer 502 can include a connector that connects the gaming terminals 10*a,b* to the handheld devices 400*a,b* for selectively passing inputs from the handheld devices 400*a,b* to one or both of the gaming terminals 10*a,b* and/or selectively providing outputs (e.g., haptic feedback signals, lighting signals, audio signals, any combinations thereof, etc.) from the gaming terminals 10*a,b* and/or the gaming system 500 to one or both of the handheld devices 400*a,b* via the cables 406*a,b*. Alternately, the handheld devices 400*a,b* can wirelessly communicate with one or both of the gaming terminals 10*a,b* and/or the gaming system 500 or the external system 48 via the wireless communications interface 412 (FIG. 4), eliminating the need for any physical connections between the spacer 502 and the gaming terminals 10*a,b* and/or the gaming system 500.

The range of detectable motion and/or the range of acceptable motion of the handheld devices 400 relative to the gaming terminals 10*a,b* and/or the spacer 502 is generally confined to one or more volumetric spaces. By range of acceptable motion it is generally meant to include a volumetric space in which inputs (e.g., button pushes, movements, such as, up-down gestures, down-up gestures, side-to-side gestures, etc.) made using the handheld devices 400*a,b* are detected and accepted for use in conducting at least a portion of a wagering game on the gaming system 500. The inputs are detected by the handheld device 400 and/or the gaming system 500 using one or more sensor(s). The sensor(s) can be, for example, the button 420, the switch 416, the controller 414, the position and/or orientation sensor 418, the communication interface 412, the processor 30, or any combination thereof. The one or more volumetric spaces can be predefined (e.g., a predefined zone) and/or definable by players of the gaming system 500, such as, for example, a definable zone and/or a configurable zone. The zones (predefined and definable) can include one or more of the volumetric spaces or any portion or portions thereof.

For example, as shown in FIGS. 6A-6C, a first volumetric space 520, illustrated by a dashed three-dimensional shape, is generally positioned in front of the housing 11 of the first gaming terminal 10*a*. In some implementations of the present disclosure, the first volumetric space 520 defines a first predefined zone used in calibrating the handheld devices 400*a,b* as described below. In some such implementations, when one of the handheld devices 400*a,b* is positioned within the first predefined zone, that handheld device is usable for providing input (e.g., placing a max wager in a slots-type wagering game causing reels to spin, selecting a player selectable element in a bonus game, etc.) into the first gaming terminal 10*a*.

In some alternative implementations, a definable zone (e.g., not a predefined zone) can be defined as any portion of the first volumetric space 520. For example, the upper half of the first volumetric space 520 can be defined as a zone. For another example, the lower half of the first volumetric space 520 can be defined as a zone. For yet another example, a middle portion of the first volumetric space 520 can be defined as a zone. In some such alternative implementations, after a zone is defined and/or established, that defined zone is defined by a volumetric space (e.g., a portion of the first volumetric space 520) in which inputs (e.g., button pushes, movements, such as, up-down gestures, down-up gestures, side-to-side gestures, etc.) made using one or both of the handheld devices 400*a,b* are detected and accepted for use in conducting at least a portion of a wagering game on the gaming system 500.

Further, while the first volumetric space 520 is shown as having a particular size (e.g., volume) in a particular location—for example, as being completely in front of the housing 11 of the first gaming terminal 10*a* and completely in front of a back portion of a chair 515*a* associated with the first gaming terminal 10*a*—the first volumetric space 520 can be any size (e.g., any volume) and positioned anywhere relative to the first gaming terminal 10*a* such that a player of the wagering game conducted on the first gaming terminal 10*a* is able to play the wagering game while holding one of the handheld devices 400*a,b* within the first volumetric space 520.

For example, the first volumetric space 520 can include about one cubic foot of volume, two cubic feet of volume, nine cubic feet of volume, thirty cubic feet of volume, one hundred cubic feet of volume, etc. Further, for example, the first volumetric space 520 can extend to include at least a portion of the space above one or both of the display devices 12, 14 of the first gaming terminal 10*a*. For another example, the first volumetric space 520 can extend to include all of, or a portion of, the space above a seat portion of the chair 515*a* associated with the first gaming terminal 10*a*. For yet another example, the first volumetric space 520 can extend to include all of, or a portion of, the space behind the chair 515*a* associated with the first gaming terminal 10*a*. Further, for example, the first volumetric space 520 can extend any amount on either side of the chair 515*a* associated with the first gaming terminal 10*a*.

Similarly, a second volumetric space 530, illustrated by a dashed three-dimensional shape, is generally positioned in front of the housing 11 of the second gaming terminal 10*b*. In some implementations of the present disclosure, the second volumetric space 530 defines a second predefined zone. In such implementations, when one of the handheld devices 400*a,b* is positioned within the second predefined zone, that handheld device is usable for providing input (e.g., placing a max wager in a slots-type wagering game causing reels to spin, selecting a player selectable element in a bonus game, etc.) into the second gaming terminal 10*b*.

In some alternative implementations, a definable zone (e.g., not a predefined zone) can be defined as any portion of the second volumetric space 530 in the same, or similar, manner that a definable zone can be defined as any portion of the first volumetric space 520 described above.

Further, while the second volumetric space 530 is shown as having a particular size (e.g., volume) in a particular location—for example, as being completely in front of the housing 11 of the second gaming terminal 10*b* and completely in front of a back portion of a chair 515*b* associated with the second gaming terminal 10*b*—the second volumetric space 530 can be any size (e.g., any volume) and positioned anywhere relative to the second gaming terminal 10*b* such that a player of the wagering game conducted on the second gaming terminal 10*b* is able to play the wagering game while holding one of the handheld devices 400*a,b* within the second volumetric space 530.

For example, the second volumetric space 530 can include about one cubic foot of volume, two cubic feet of volume, nine cubic feet of volume, thirty cubic feet of volume, one hundred cubic feet of volume, etc. Further, for example, the second volumetric space 530 can extend to include the space above one or both of the display devices 12, 14 of the second gaming terminal 10*b*. For another example, the second volumetric space 530 can extend to include all of, or a portion of, the space above a seat portion of the chair 515*b* associated with the second gaming terminal 10*b*. For yet another example, the second volumetric space 530 can extend to include all of, or a portion of, the space behind the chair 515*b* associated with the second gaming terminal 10*b*.

Further, the second volumetric space 530 can extend any amount on either side of the chair 515*b* associated with the second gaming terminal 10*b*. As such, in some implementations of the present disclosure, the first volumetric space 520 and the second volumetric space 530 can be completely separate and distinct (e.g., no overlapping), completely overlapping (e.g., the first volumetric space 520 is the same as the second volumetric space 530), or partially overlapping (e.g., like a Venn diagram).

A third and/or base volumetric space 540, illustrated by a dashed three-dimensional shape, is generally positioned around a portion of the spacer 502. In particular, the base volumetric space 540 is positioned around a docking station 510 of the spacer 502. In some implementations of the present disclosure, the base volumetric space 540 defines a third predefined zone and/or a base predefined zone. In such implementations, when one of the handheld devices 400*a,b* is positioned within the base predefined zone, that handheld device is usable for providing input (e.g., placing a max wager in a slots-type wagering game causing reels to spin, selecting a player selectable element in a bonus game, etc.) into the first gaming terminal 10*a* and/or into the second gaming terminal 10*b*.

Further, while the base volumetric space 540 is shown as having a particular size (e.g., volume) in a particular location—for example, as being positioned generally around the docking station 510 of the spacer 502—the base volumetric space 540 can be any size (e.g., any volume) and can be positioned anywhere relative to the spacer 502 such that the handheld devices 400*a,b* are within the base volumetric space 540 when docked with the docking station 510.

For example, the base volumetric space 540 can include about 0.2 cubic feet of volume, 0.5 cubic feet of volume, 0.8 cubic feet of volume, one cubic foot of volume, one hundred cubic feet of volume, etc. Further, for example, the base volumetric space 540 can extend to include at least a portion of the space above one or both of the display devices 12, 14 of the first gaming terminal 10*a* and/or of the second gaming terminal 10*b*. For another example, the base volumetric space 540 can extend to include all of, or a portion of, the space above a seat portion of one or both of the chairs 515*a,b*. Further, the base volumetric space 540 can extend any amount on either side of the spacer 502.

Thus, in some implementations, the first volumetric space 520, the second volumetric space 530, and the base volumetric space 540 can be completely separate and distinct (e.g., no overlapping) or partially overlapping (e.g., the base volumetric space 540 can partially overlap with just the first volumetric space 520, with just the second volumetric space 530, or both).

Referring to FIGS. 7A-7D, methods of calibrating the handheld devices 400 for use in conducting the wagering game on either of the gaming terminals 10*a,b* are described. That is, the handheld devices 400*a,b* can be selectively calibrated to be used with the first gaming terminal 10*a* or the second gaming terminal 10*b* and recalibrated to be used with the other of the gaming terminals 10*a,b*.

Figure 7A:
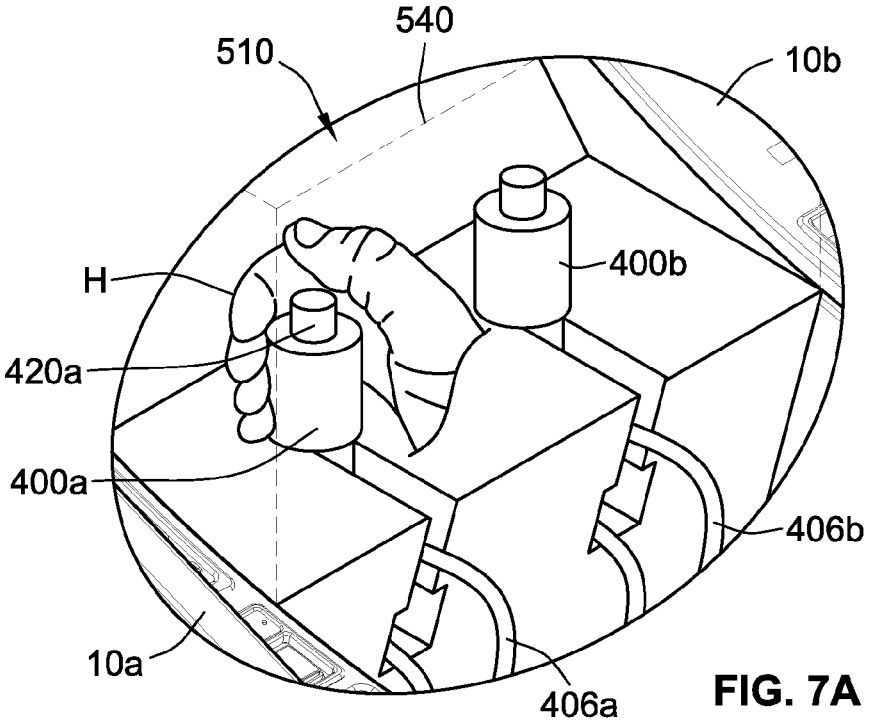
FIGS. 7A-7E are enlarged perspective views of portions of the gaming system of FIG. 6A illustrating calibration methods according to some implementations of the preset disclosure.

Initially, for example, to calibrate the first handheld device 400*a* to be used with the first gaming terminal 10*a*, the first handheld device 400*a* is coupled to (e.g., docked) the docking station 510 of the fixed structure 502 of the wagering game system 500, as shown in FIG. 7A. For example, a hand H of a player of the first gaming terminal 10*a* can place the handheld device 400*a* in the docking station 510. As such, the first handheld device 400*a* is positioned within the base predefined zone defined by the base volumetric space 540 that is positioned about the docking station 510 of the fixed structure 502. Step-by-step instructions on how to calibrate the first handheld device 400*a* can be concurrently displayed on one or both of the display devices 12, 14 of the first gaming terminal 10*a*. For example, the instruction, "Place the Remote into the Docking Station," can appear on the primary display device 12 of the first gaming terminal 10*a*.

Figure 7B:
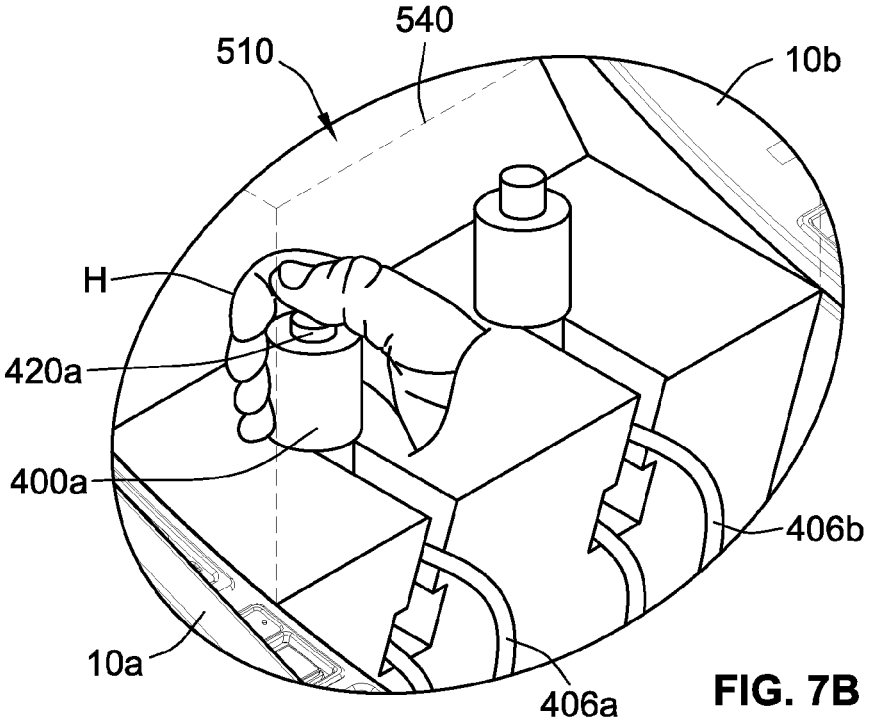

After the gaming system 500 detects that the first handheld device 400*a* is docked within the docking station 510 and thus, the first handheld device 400*a* is detected within the base predefined zone, a second instruction can be displayed to the player, such as, for example, "Press the Button." As shown in FIG. 7B, in response to such an instruction, the hand H of the player can press the button 420*a* of the first handheld device 400*a*. Alternatively, to placing the first handheld device 400*a* into the docking station 510 and pressing the button, the instructions can be "Shake the Remote Near the Docking Station" (not shown). Regardless if the button 420*a* is pressed, if the first handheld device 400*a* is shaken, or some other input (e.g., pressure sensed on the pressure sensitive pad (not shown) of the handheld device 400*a*) is made, the gaming system 500 detects the input as a first calibration input within the base predefined zone. In the case of the button 420 being pressed, the detection can be by the controller 414 (FIG. 4) via the switch 416 (FIG. 4) and/or via the position and/or orientation sensors 418 and in the case of the first handheld device 400*a* being shaken, the detection can be by the controller 414 (FIG. 4) via the position and/or orientation sensors 418 (FIG. 4).

Figure 7C:
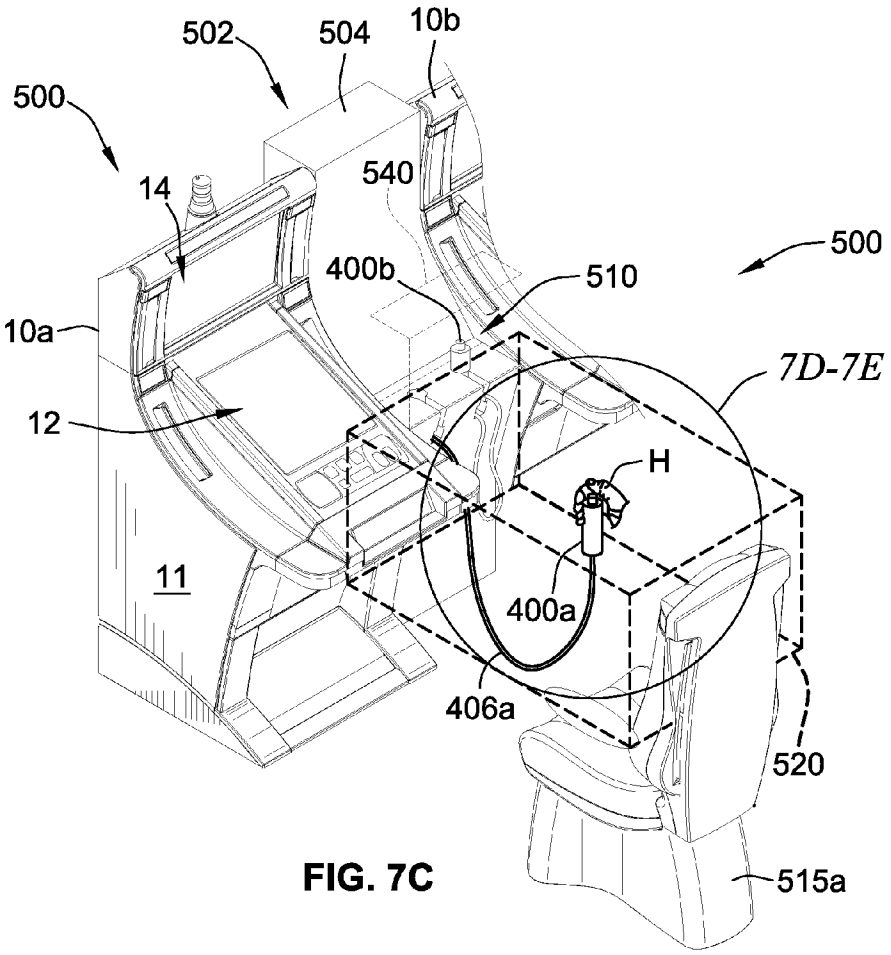

After the gaming system 500 detects the first calibration input within the base predefined zone, a third instruction can be displayed to the player, such as, for example, "Grab the Remote and Sit in the Chair." In response to such an instruction, the player decouples the first handheld device 400*a* from the docking station 502 and positions the first handheld device 400*a* in the first predefined zone defined by the first volumetric space 520 adjacent to the display devices 12, 14 of the first gaming terminal 10*a* of the gaming system 500, as shown in FIG. 7C. Alternatively, the third instruction can be, for example, "Position the Remote in Front of the Display," or "Grab the Remote and Stand in Front of the Display."

Figure 7E:
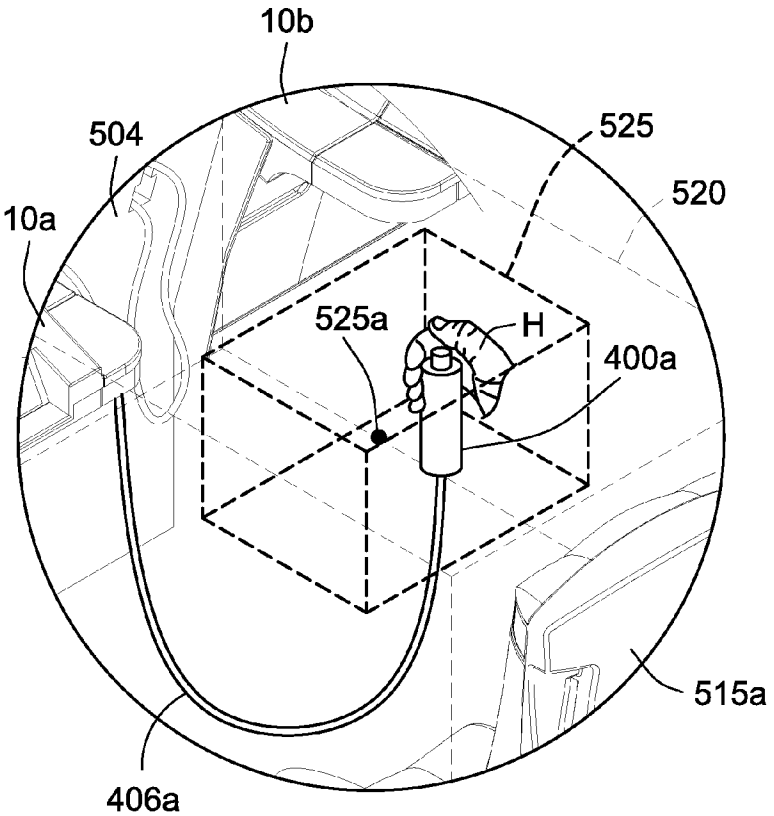
Figure 7D:
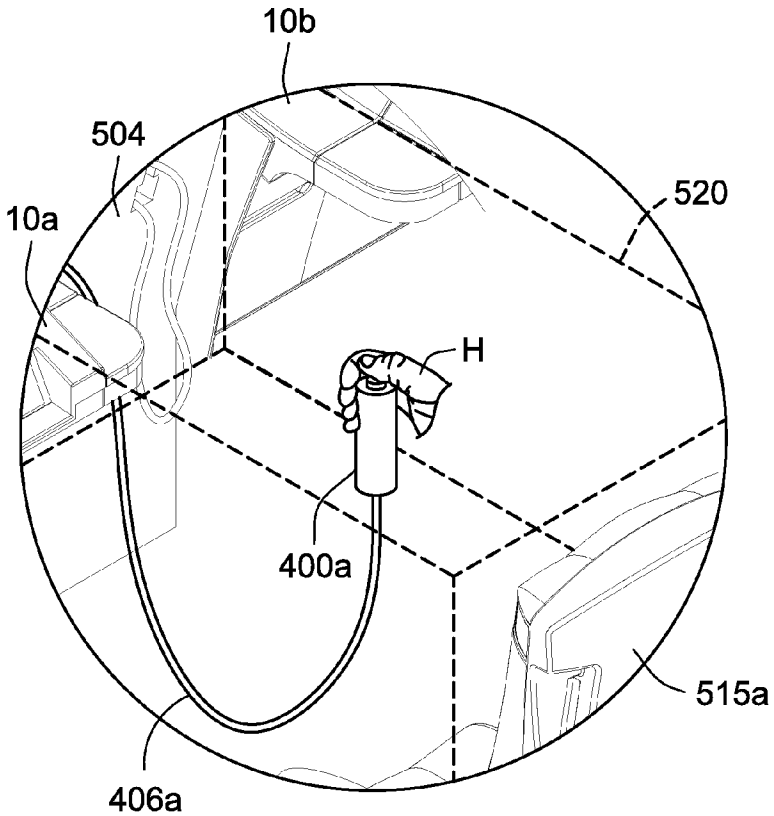

After the gaming system 500 detects that the first handheld device 400*a* is within the first predefined zone, a fourth instruction can be displayed to the player, such as, for example, "Press the Button." As shown in FIG. 7D, in response to such an instruction, the hand H of the player can press the button 420*a* of the first handheld device 400*a* a second time. Alternatively, to positioning the first handheld device 400*a* in the first predefined zone and pressing the button, the instructions can be "Shake the Remote in Front of the Display." Regardless if the button 420 is pressed, if the first handheld device 400*a* is shaken, or some other input (e.g., pressure sensed on the pressure sensitive pad (not shown) of the handheld device 400*a*) is made, the gaming system 500 detects the input as a second calibration input within the first predefined zone. In the case of the button 420 being pressed (shown in FIG. 7D), the detection can be by the controller 414 (FIG. 4) via the switch 416 (FIG. 4) and/or via the position and/or orientation sensors 418 and in the case of the first handheld device 400*a* being shaken, the detection can be by the controller 414 (FIG. 4) via the position and/or orientation sensors 418 (FIG. 4).

According to some implementations, in response to the gaming system 500 detecting the second calibration input within the first predefined zone, the first handheld device 400*a* is associated with the first gaming terminal 10*a* for use in playing the wagering game thereon. That is, the first handheld device 400*a* was calibrated to be used with the first gaming terminal 10*a*, as opposed to being used with the second gaming terminal 10*b*.

The second handheld device 400*b* can be calibrated to be used with the second gaming terminal 10*b* similarly to how the first handheld device 400*a* is calibrated to be used with the first gaming terminal 10*a*. Initially, to calibrate the second handheld device 400*b* to be used with the second gaming terminal 10*b*, the second handheld device 400*b* is coupled to (e.g., docked) the docking station 510 of the fixed structure 502 of the wagering game system 500. As such, the second handheld device 400*b* is positioned within the base predefined zone defined by the base volumetric space 540 that is positioned about the docking station 510 of the fixed structure 502.

A first instruction, "Place the Remote into the Docking Station" can appear on the primary display device 12 of the second gaming terminal 10*b*. After the gaming system 500 detects that the second handheld device 400*b* is docked within the docking station 510 and thus, the second handheld device 400*b* is detected within the base predefined zone, a second instruction can be displayed to the player, such as, for example, "Press the Button." Alternatively, to placing the second handheld device 400*b* into the docking station 510 and pressing the button, the instructions can be "Shake the Remote Near the Docking Station." Regardless if the button 420 is pressed, if the second handheld device 400*b* is shaken, or some other input (e.g., pressure sensed on the pressure sensitive pad (not shown) of the handheld device 400*b*) is made, the gaming system 500 detects the input as a first calibration input within the base predefined zone in the same, or similar, manner as described above in reference to calibrating the first handheld device 400*a*.

After the gaming system 500 detects the first calibration input within the base predefined zone, a third instruction can be displayed to the player, such as, for example, "Grab the Remote and Sit in the Chair." In response to such an instruction, the player decouples the second handheld device 400*b* from the docking station 502 and positions the second handheld device 400*b* in the second predefined zone defined by the second volumetric space 530 adjacent to the display devices 12, 14 of the second gaming terminal 10*b* of the gaming system 500. Alternatively, the third instruction can be, for example, "Position the Remote in Front of the Display," or "Grab the Remote and Stand in Front of the Display."

After the gaming system 500 detects that the second handheld device 400*b* is within the second predefined zone, a fourth instruction can be displayed to the player, such as, for example, "Press the Button." Alternatively, to positioning the second handheld device 400*b* in the second predefined zone and pressing the button, the instructions can be "Shake the Remote in Front of the Display." Regardless if the button 420 is pressed, if the second handheld device 400*b* is shaken, or some other input (e.g., pressure sensed on the pressure sensitive pad (not shown) of the handheld device 400*b*) is made, the gaming system 500 detects the input as a second calibration input within the second predefined zone in the same, or similar, manner as described above in reference to calibrating the first handheld device 400*a*.

According to some implementations, in response to the gaming system 500 detecting the second calibration input within the second predefined zone, the second handheld device 400*b* is associated with the second gaming terminal 10*b* for use in playing the wagering game thereon. That is, the second handheld device 400*b* was calibrated to be used with the second gaming terminal 10*b*, as opposed to being used with the first gaming terminal 10*a*.

After the first and the second handheld devices 400*a,b* are calibrated for use in playing the wagering game on the first and the second gaming terminals 10*a,b*, respectively, the first and the second handheld devices 400*a,b* can be recalibrated for use in playing the wagering game on the other of the first and the second gaming terminals 10*a,b*.

For example, after the first handheld device 400*a* is calibrated and associated with the first gaming terminal 400*a*, the first handheld device 400*a* can be selectively recalibrated to be used in playing the wagering game on the second gaming terminal 10*b* similarly to how the first handheld device 400*a* was originally calibrated to be used with the first gaming terminal 10*a*. Recalibration of the first handheld device 400*a* can be prompted by the gaming system 500, one of the gaming terminals 10*a,b*, and/or the player of the wagering game. For example, the gaming system 500 may prompt the player of the second gaming terminal 10*b* to recalibrate the first handheld device 400*a* in response to the gaming system 500 detecting (e.g., via the position and/or orientation sensor 418 and/or the processor 30) that the first handheld device 400*a* is positioned within the second predefined zone defined by the second volumetric space 530 generally positioned in front of the housing 11 of the second gaming terminal 10*b*. Such may be the case when the player of the first gaming terminal inadvertently grabs the wrong handheld device (e.g., the second handheld device 400*b* previously calibrated for use with the second gaming terminals 10*b*) forcing the player of the second gaming terminal 10*b* to use the first handheld device 400*a* with the second gaming terminal 10*b*. Alternatively, or in addition thereto, the gaming system 500 may indicate to the player of the first and/or the second gaming terminals 10*a,b* that the wrong handheld device(s) 400 was grabbed, by for example, displaying one or more instructions on one or more of the display devices 12, 14 of the first gaming terminal 10*a*, on one or more of the display devices 12, 14 of the second gaming terminal 10*b*, on a community display device (not shown), or a combination thereof.

Initially, to recalibrate the first handheld device 400*a* to be used with the second gaming terminal 10*b*, the first handheld device 400*a* is recoupled to (e.g., docked) the docking station 510 of the fixed structure 502 of the wagering game system 500. As such, the first handheld device 400*a* is repositioned within the base predefined zone defined by the base volumetric space 540 that is positioned about the docking station 510 of the fixed structure 502.

A fifth instruction, "Place the Remote into the Docking Station" can appear on the primary display device 12 of the second gaming terminal 10*b*. After the gaming system 500 detects that the first handheld device 400*a* is docked within the docking station 510 and thus, the first handheld device 400*a* is detected within the base predefined zone, a sixth instruction can be displayed to the player, such as, for example, "Press the Button." Alternatively, to placing the first handheld device 400*a* into the docking station 510 and pressing the button, the instructions can be "Shake the Remote Near the Docking Station." Regardless if the button 420 is pressed, if the first handheld device 400*a* is shaken, or some other input (e.g., pressure sensed on the pressure sensitive pad (not shown) of the handheld device 400*a*) is made, the gaming system 500 detects the input as a third calibration input within the base predefined zone in the same, or similar, manner as described above in reference to calibrating the first handheld device 400*a* for use with the first gaming terminal 10*a*.

After the gaming system 500 detects the third calibration input within the base predefined zone, a seventh instruction can be displayed to the player, such as, for example, "Grab the Remote and Sit in the Chair." In response to such an instruction, the player decouples the first handheld device 400*a* from the docking station 502 and positions the first handheld device 400*a* in the second predefined zone defined by the second volumetric space 530 adjacent to the display devices 12, 14 of the second gaming terminal 10*b* of the gaming system 500. Alternatively, the seventh instruction can be, for example, "Position the Remote in Front of the Display," or "Grab the Remote and Stand in Front of the Display."

After the gaming system 500 detects that the first handheld device 400*a* is within the second predefined zone, an eight instruction can be displayed to the player, such as, for example, "Press the Button." Alternatively, to positioning the first handheld device 400*a* in the second predefined zone and pressing the button, the instructions can be "Shake the Remote in Front of the Display." Regardless if the button 420 is pressed, if the first handheld device 400*a* is shaken, or some other input (e.g., pressure sensed on the pressure sensitive pad (not shown) of the handheld device 400*a*) is made, the gaming system 500 detects the input as a fourth calibration input within the second predefined zone in the same, or similar, manner as described above in reference to calibrating the first handheld device 400*a* for use with the first gaming terminal 10*a*.

According to some implementations, in response to the gaming system 500 detecting the fourth calibration input within the second predefined zone, the first handheld device 400*a* is disassociated with the first gaming terminal 10*a* and associated with the second gaming terminal 10*b* for use in playing the wagering game thereon. That is, the first handheld device 400*a* was recalibrated to be used with the second gaming terminal 10*b*.

While specific methods for calibrating the handheld devices 400*a,b* have been described above, other methods for calibrating the handheld devices 400*a,b* are possible. For example, in some alternative implementations, the initial placement of the handheld devices 400*a,b* in the base predefined zone and pressing the button 420 can be omitted. In such alternatives, calibration can be limited to positioning the handheld device 400 generally in front of the gaming terminal 10 to be played by the player and pressing the button 420 and/or providing some other type of input (e.g., shaking the handheld device 400, squeezing a pressure pad on the handheld device 400, etc.).

Further, in addition to, or in lieu of, the calibration methods described above in reference to FIGS. 7A-7D, the handheld devices 400*a,b* can be calibrated to define and/or establish a zone defined by a portion of a volumetric space (e.g., a portion of the first volumetric space 520) for use in playing the wagering game. That is, the handheld devices 400*a,b* can be selectively calibrated to be used within a portion of the volumetric spaces 520, 530, 540—during certain portion(s) of the wagering game—depending on, for example, a location of the handheld device 400 during the calibration process.

Initially, for example, to calibrate the first handheld device 400*a* to be used in a definable zone and/or a configurable zone with the first gaming terminal 10*a*, the first handheld device 400*a* is coupled to (e.g., docked) the docking station 510 of the fixed structure 502 of the wagering game system 500, in the same, or similar, manner as shown in FIG. 7A. As such, the first handheld device 400*a* is positioned within the base predefined zone defined by the base volumetric space 540 that is positioned about the docking station 510 of the fixed structure 502 (FIG. 7A). Step-by-step instructions on how to calibrate the first handheld device 400*a* can be concurrently displayed on one or both of the display devices 12, 14 of the first gaming terminal 10*a* in the same, or similar, manner as described above.

After the gaming system 500 detects the first calibration input within the base predefined zone and the third instruction is displayed to the player (similar as described above), the player decouples the first handheld device 400*a* from the docking station 502 and positions the first handheld device 400*a* at a specific location within the first volumetric space 520 (e.g., within the definable zone) adjacent to the display devices 12, 14 of the first gaming terminal 10*a* of the gaming system 500, in the same, or similar, manner as shown in FIG. 7C.

In some implementations, when the second calibration input is detected by the gaming system 500 with the handheld device 400*a* within the first volumetric space 520 (e.g., within the definable zone), a first zone 525 is established, as shown in FIG. 7E. In some such implementations as shown in FIG. 7E, the first zone 525 is established and/or defined as an area (e.g., a volumetric space) in front of one or both of the display devices 12, 14 of the first gaming terminal 10*a* where the handheld device 400*a* is usable for providing input to the gaming system 500 during play of the basic wagering game, during play of the bonus game, or a combination thereof. The first zone 525, defined by the area, is a subset and/or a portion of the first volumetric space 520. As such, the first zone 525 is different than the first predetermined zone (defined by the first volumetric area 520) in that the first zone 525 is established as an area that is a subset of the first volumetric space 520, whereas the first predefined zone is automatically defined as the entire first volumetric space 520 (e.g., not a subset).

The first zone 525 is established about a central point 525*a* that corresponds with the precise location of the handheld device 400*a* within the first volumetric space 520 when the second calibration input is detected by the gaming system 500. Thus, the first zone 525 is centered on the central point 525*a*. Such a method of calibration can be useful when calibrating the handheld device 400*a* for use with players of different sizes and/or heights. For example, a taller player calibrating the handheld device 400*a* according to the present disclosure can establish the first zone 525 around a central point 525*a* that is relatively higher (e.g., further from a ground supporting the gaming terminal 10*a*) than a relatively shorter player. As such, use of the handheld device 400*a* by the players can be more accurate and/or provide corresponding functions and/or displays that are tailored to the size and/or height of the player. Various other benefits can be achieved by calibrating the handheld device 400*a* according to the above methods and/or processes.

Thus, according to some implementations, in response to the gaming system 500 establishing the first zone 525, the first handheld device 400*a* is (1) associated with the first gaming terminal 10*a* for use in playing the wagering game thereon and (2) associated with the established area about the central point 525*a*. That is, the first handheld device 400*a* was calibrated to be used with the first gaming terminal 10*a*, as opposed to being used with the second gaming terminal 10*b*, and further calibrated to be used in the first zone 525 (e.g., a subset of the first volumetric space 520), as opposed to being used in the first predefined zone (defined by the entire first volumetric space 520).

Further, the first zone 525, where the handheld device 400*a* is usable for providing input, can be any size (e.g., about three feet by about three feet by about three feet, smaller, larger, etc.). In some implementations, the established first zone 525 is about 0.1 cubic feet of volume, 0.5 cubic feet of volume, 0.8 cubic feet of volume, one cubic foot of volume, two cubic feet of volume, nine cubic feet of volume, thirty cubic feet of volume, one hundred cubic feet of volume, etc. In some such implementations, the first zone 525 is always a subset and/or a portion of (e.g., smaller than) the encompassing volumetric space (e.g., the first volumetric space 520).

Generally referring to FIG. 6A, according to some implementations of the present disclosure, after the handheld devices 400*a,b* are calibrated, the gaming system 500 is configured to perform one or more functions in response to receiving one or more inputs from the handheld devices 400*a,b*. For example, in response to the first handheld device 400*a* being calibrated for use in playing a wagering game on the first gaming terminal 10*a* (FIGS. 7A-7D) and being positioned within the base predefined zone defined by at least a portion of the base volumetric space 540, a first input being detected by the gaming system 500 (e.g., by the processor 30) is accepted and causes the gaming system 500 to perform a first function.

The first input can be, for example, a press of the button 420, a movement of the handheld device 400, also referred to as a gesture, etc. The gesture can include, for example, moving, by the player of the wagering game conducted on the first gaming terminal 10*a*, the first handheld device 400*a* in an up-down fashion relative to the spacer 502 and/or the cabinet 11 of the first gaming terminal 10*a*, in a side-to-side fashion relative to the spacer 502 and/or the cabinet 11 of the first gaming terminal 10*a*, or a combination of both.

The first function can include, for example, conducting a play of a basic wagering game and displaying a randomly selected outcome of the basic wagering game on the primary and/or secondary display devices 12, 14 of the first gaming terminal 10*a*. For another example, the first function can include placing a max bet on a play of the basic wagering game on the first gaming terminal 10*a* and displaying a randomly determined outcome on the primary display area 12 of the first gaming terminal 10*a*. For yet another example, the first function can include causing a help menu associated with the wagering game to be displayed on one or both of the display areas 12, 14 of the first gaming terminal 10*a*. For yet another example, the first function can include pausing play of the wagering game being conducted on the first gaming terminal 10*a*. Further, the first function can include selecting a player selectable element in a bonus game of the wagering game being conducted on the first gaming terminal 10*a*. For another example, the second function can include causing a curser being displayed on the primary and/or the secondary display areas 12, 14 to move (e.g., to move according to a gesture made with the handheld device 400). The first function can include various other actions.

Further, in response to the first handheld device 400*a* being calibrated for use in playing a wagering game on the first gaming terminal 10*a* and being positioned within the first predefined zone defined by at least a portion of the first volumetric space 520, a second input (e.g., a press of the button 420, a movement of the handheld device 400, e.g., a gesture, etc.) being detected by the gaming system 500 (e.g., by the processor 30) is accepted and causes the gaming system 500 to perform a second function.

The second function can be the same as the first function or distinct from the first function. For example, the second function can include conducting a play of a basic wagering game on the first gaming terminal 10*a*. For another example, the second function can include placing a max bet on a play of the basic wagering game on the first gaming terminal 10*a* and displaying a randomly determined outcome on the primary display area 12 of the first gaming terminal 10*a*. For yet another example, the second function can include causing a help menu associated with the wagering game to be displayed on one or both of the display areas 12, 14 of the first gaming terminal 10*a*. For yet another example, the second function can include pausing play of the wagering game being conducted on the first gaming terminal 10*a*. Further, the second function can include selecting a player selectable element in a bonus game of the wagering game being conducted on the first gaming terminal 10*a*. For another example, the second function can include causing a curser being displayed on the primary and/or the secondary display areas 12, 14 to move (e.g., to move according to a gesture made with the handheld device 400). The second function can include various other actions.

Thus, in some implementations, a first input (e.g., a press of the button 420) detected in the base predefined zone is accepted and causes a first function (e.g., conducting a play of a basic wagering game) to be performed by the gaming system 500 and the same input (e.g., a press of the button 420) detected in the first predefined zone is accepted and causes a second function (e.g., selecting a player selectable element in a bonus game) to be performed by the gaming system 500 that is different than the first function. That is, the same input, using the handheld device 400, in two different zones can result in two different outputs (e.g., functions).

Alternatively, in some other implementations, a first input (e.g., a press of the button 420) detected in the base predefined zone is accepted and causes a first function (e.g., conducting a play of a basic wagering game) to be performed by the gaming system 500 and the same input (e.g., a press of the button 420) detected in the first predefined zone is accepted and causes a second function (e.g., conducting a play of a basic wagering game) to be performed by the gaming system 500 that is the same as, or similar to, the first function. That is, the same input, using the handheld device 400, in two different zones can result in the same output (e.g., function).

Alternatively, in yet some other implementations, a first input (e.g., a press of the button 420) detected in the base predefined zone is accepted and causes a first function (e.g., conducting a play of a basic wagering game) to be performed by the gaming system 500 and a second input (e.g., a gesture being made using the handheld device 400), different from the first input, detected in the first predefined zone is accepted and causes a second function (e.g., conducting a play of a basic wagering game) to be performed by the gaming system 500 that is the same as, or similar to, the first function. That is, different inputs, using the handheld device 400, in two different zones can result in the same output (e.g., function).

Alternatively, in yet some further implementations, a first input (e.g., a press of the button 420) detected in the base predefined zone is accepted and causes a first function (e.g., conducting a play of a basic wagering game) to be performed by the gaming system 500 and a second input (e.g., a gesture being made using the handheld device 400), different from the first input, detected in the first predefined zone is accepted and causes a second function (e.g., selecting a player selectable element in a bonus game) to be performed by the gaming system 500 that is different than the first function. That is, different inputs, using the handheld device 400, in two different zones can result in the two different outputs (e.g., functions).

Generally referring to FIG. 6A, the gaming system 500 can be setup to only accept inputs for certain portions of the wagering game (e.g., only during the basic wagering game or only during the bonus game) from the handheld devices 400*a,b* when the handheld devices 400*a,b* are positioned within certain ones of the predefined and/or configured zones defined by one or more of the volumetric spaces 520, 530, 540, and/or any portion(s) thereof.

For example, in response to the first handheld device 400*a* being calibrated for use in playing a wagering game on the first gaming terminal 10*a*, the gaming system 500 can be setup to detect and accept inputs (e.g., press of the button 420) during play of the basic wagering game only in response to the handheld device 400*a* being positioned within the base predefined zone (e.g., defined by the base volumetric space 540). In some such implementations, the gaming system 500 can be setup to detect and ignore inputs (e.g., press of the button 420) during play of the basic wagering game in response to the handheld device 400*a* being positioned within the first predefined zone (e.g., defined by the first volumetric space 520) and/or in the second predefined zone (e.g., defined by the second volumetric space 530).

Similarly, for example, in response to the first handheld device 400*a* being calibrated for use in playing a wagering game on the first gaming terminal 10*a*, the gaming system 500 can be setup to detect and accept inputs (e.g., press of the button 420) during play of the bonus game only in response to the handheld device 400*a* being positioned within the first predefined zone (e.g., defined by the first volumetric space 520). In some such implementations, the gaming system 500 can be setup to detect and ignore inputs (e.g., press of the button 420) during play of the bonus game in response to the handheld device 400*a* being positioned within the base predefined zone (e.g., defined by the base volumetric space 540) and/or in the second predefined zone (e.g., defined by the second volumetric space 530).

Alternatively, in some implementations, in response to the first handheld device 400*a* being calibrated for use in playing a wagering game on the first gaming terminal 10*a*, the gaming system 500 can be setup to detect and accept inputs (e.g., press of the button 420) during play of the basic wagering game only in response to the handheld device 400*a* being positioned within the first predefined zone (e.g., defined by the first volumetric space 520). In some such alternative implementations, the gaming system 500 can be setup to detect and ignore inputs (e.g., press of the button 420) during play of the basic wagering game in response to the handheld device 400*a* being positioned within the base predefined zone (e.g., defined by the base volumetric space 540) and/or in the second predefined zone (e.g., defined by the second volumetric space 530).

Similarly, in some such alternative implementations, in response to the first handheld device 400*a* being calibrated for use in playing a wagering game on the first gaming terminal 10*a*, the gaming system 500 can be setup to detect and accept inputs (e.g., press of the button 420) during play of the bonus game only in response to the handheld device 400*a* being positioned within the base predefined zone (e.g., defined by the base volumetric space 540). In some such alternative implementations, the gaming system 500 can be setup to detect and ignore inputs (e.g., press of the button 420) during play of the bonus game in response to the handheld device 400*a* being positioned within the first predefined zone (e.g., defined by the first volumetric space 520) and/or in the second predefined zone (e.g., defined by the second volumetric space 530).

Thus, in some implementations of the present disclosure, when a handheld device 400 is calibrated for use in playing a wagering game on a particular gaming terminal 10, that handheld device 400 can be setup to only be used in specific zones for use in playing the basic wagering games and different specific zones for use in playing the bonus game. Alternatively, the handheld devices 400 of the present disclosure 400 can be used to play any portion of the wagering game conducted on the gaming terminals 10 while being positioned within any one or more of the predefined and/or configured zones and/or outside of any one or more of the predefined and/or configured zones.

Figure 8A:
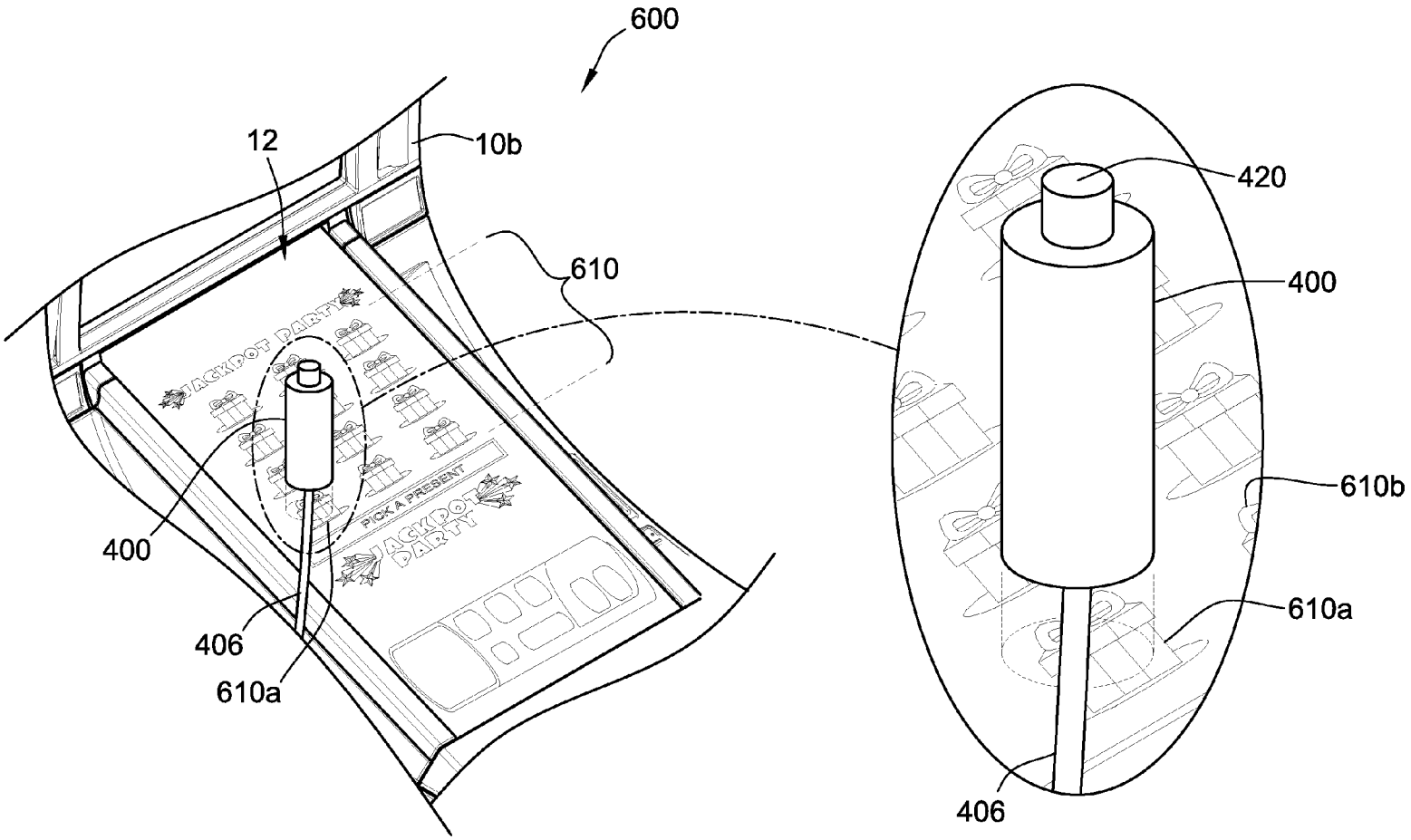
FIGS. 8A-8C are partial perspective views of a gaming system including a gaming terminal and a handheld device tethered thereto for use in conducting a bonus game including a hovering feature according to some implementations of the present disclosure.
Figure 8B:
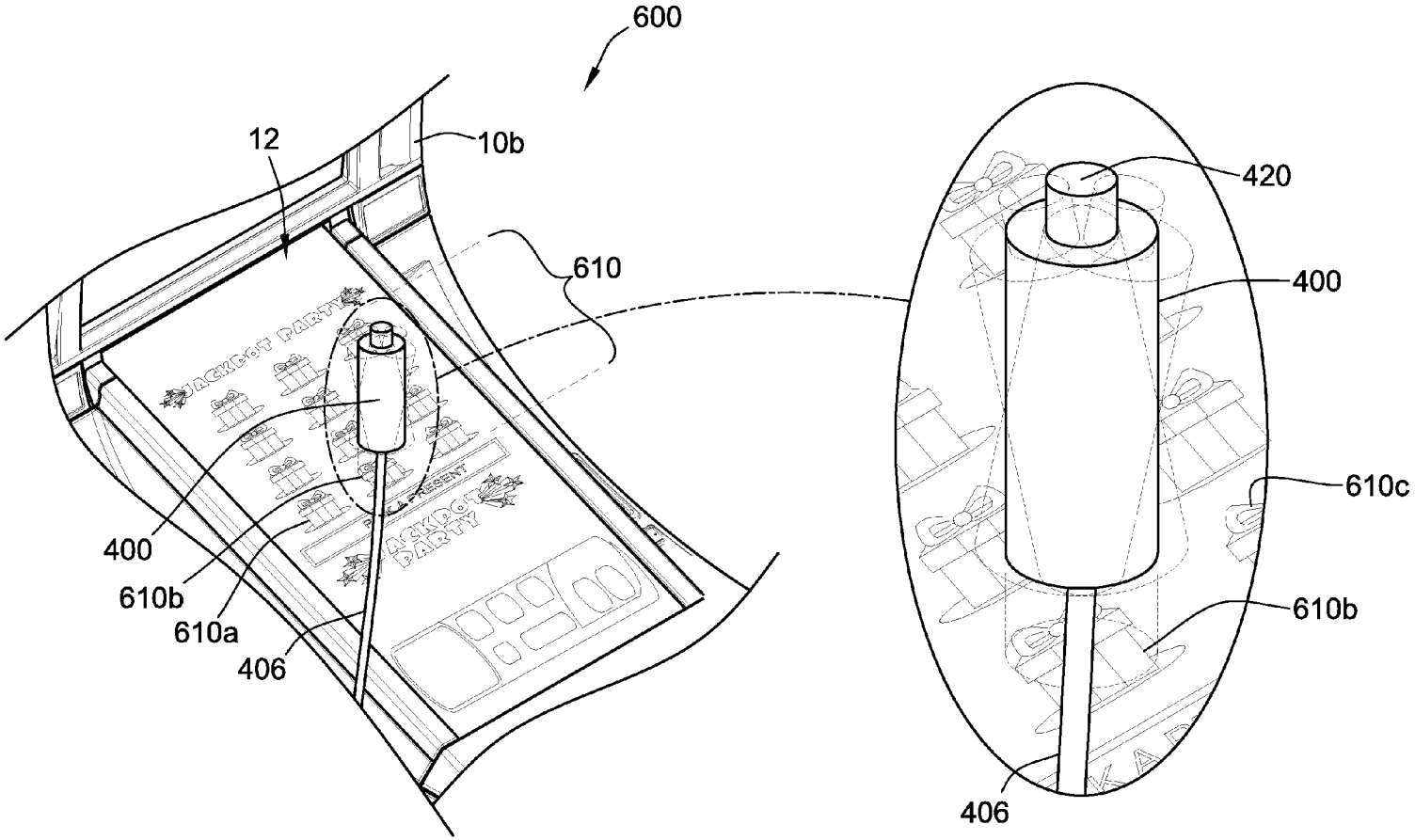
Figure 8C:
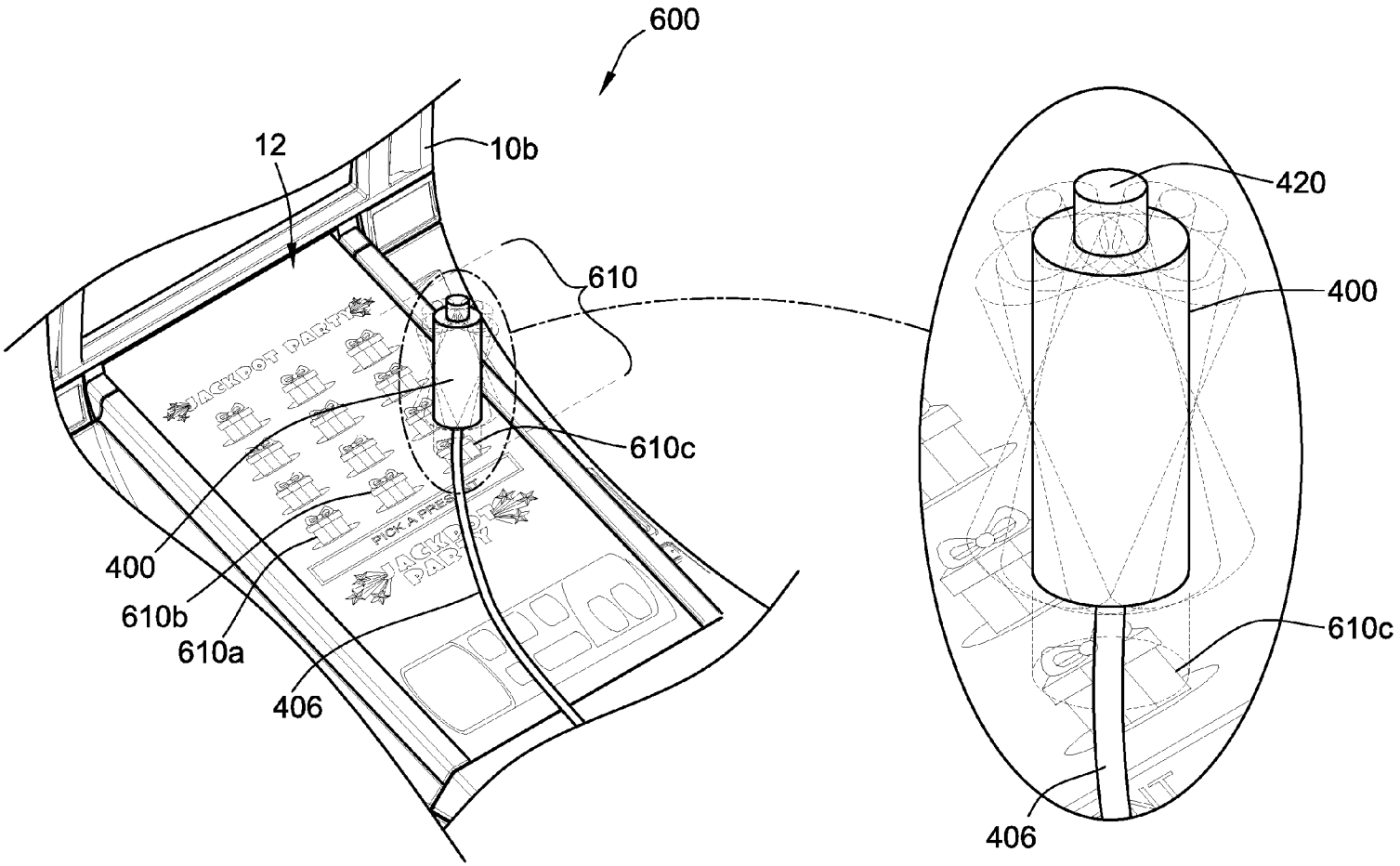

Now referring to FIGS. 8A-8C, an example configuration of a gaming system 600 (e.g., a community gaming system, a standalone gaming terminal, etc.) is shown including a gaming terminal 10 and a handheld device 400 coupled thereto via a cable 406. While not shown, the handheld device 400 can be coupled directly to the gaming terminal 10 or via a spacer (e.g., the fixed structure 402, the spacer 502, etc.).

According to some implementations, the handheld device 400 of the gaming system 600 can be used during a bonus game (e.g., Jackpot Party as shown in FIGS. 8A-8C) displayed on the primary display device 12 of the gaming terminal 10 to add excitement for the player and/or to give the player the perception of having additional information and/or control over the outcome of the bonus game. In particular, the player can waive and/or move the handheld device 400 in a predefined zone of a volumetric space adjacent to at least one of the display devices 12, 14. That is, for example, the player can hover the handheld device 400 above the primary display device 12 (e.g., as shown in FIGS. 8A-8C) displaying the bonus game. As the player hovers the handheld device 400 (or a portion of the handheld device 400) over the primary display device 12, the gaming system 600 (using the processor 30) can cause the handheld device 400 to indicate which ones, if any, of a multitude of player selectable elements 610 are associated with awards (also referred to as a hovering feature). As the awards are visually hidden from the player until the corresponding player selectable element 610 is selected by the player, the indication by the handheld device 400 gives the player the perception that the player is receiving additional information that might lead to an award and/or a relatively larger award than the player would have received without hovering the handheld device 400 over the primary display device 12.

For example, the handheld device 400 can indicate which ones, if any, of the multitude of player selectable elements 610 are associated with awards by vibrating, using the haptic feedback device 408*a* (FIG. 4), when positioned adjacent to one of the player selectable elements 610 that is associated with an award. The vibrating, thus, indicates to the player that the adjacent player selectable element 610 (the one being hovered over) should be selected as it is associated with an award (e.g., credits).

Additionally, the handheld device 400 can indicate the size of the visually hidden award by vibrating more or less as the handheld device 400 is hovered above ones of the plurality of player selectable elements 610. When the handheld device 400 is hovered over (e.g., positioned adjacent to) ones of the plurality of player selectable elements 610 that are not associated with an award, the handheld device 400 can indicate that the adjacent player selectable element is not associated with an award by vibrating less (e.g., vibrating at a different frequency, such as, a lower frequency), or not at all.

For example, as shown in FIG. 8A, the handheld device 400 is hovered over a first one of the player selectable elements 610*a* by the player of the bonus game being displayed on the primary display device 12. The handheld device 400 is not vibrating, which indicates to the player that the first player selectable element 610*a* is not associated with an award (or associated with a relatively small award).

Thus, the player is encouraged to move the handheld device 400 to hover over other ones of the player selectable elements 610 in the hopes of finding an award (e.g., by having the handheld device 400 vibrate).

As the player scans the additional player selectable elements 610 by moving the handheld device 400 around the primary display device 12, the handheld device 400 begins to vibrate as it is hovered closer to a player selectable element 610 associated with an award. For example, as shown in FIG. 8B, the handheld device 400 is hovered over a second one of the player selectable elements 610*b* by the player of the bonus game being displayed on the primary display device 12. The handheld device 400 begins to vibrate, which can indicate to the player (1) that the second player selectable element 610*b* is associated with an award, or (2) that the second player selectable element 610*b* is relatively closer than the first player selectable element 610*a* to another player selectable element 610 that is associated with an award. Thus, the player can select the second player selectable element 610*b* to see if it is associated with an award in accordance with the bonus game, but more likely, the player is encouraged to move the handheld device 400 to hover over adjacent ones of the player selectable elements 610 in the hopes of having the handheld device 400 vibrate more (e.g., vibrate at a higher frequency and/or more vigorous).

For example, as shown in FIG. 8C, the handheld device 400 is moved further to the right and hovered over a third one of the player selectable elements 610*c* by the player of the bonus game being displayed on the primary display device 12. The handheld device 400 continues to vibrate, but at a higher frequency (e.g., more vigorously), which can indicate to the player (1) that the third player selectable element 610*c* is associated with an award, and/or (2) that the third player selectable element 610*c* is associated with an award that is relatively larger than an award associated with the second player selectable element 610*b*. Thus, with the perceived knowledge about which ones of the player selectable elements 610 are associated with awards (and/or relatively larger awards), the player can select one or more of the player selectable elements 610, in accordance with the bonus game rules, to see what actual awards are associated therewith.

In addition to, or in lieu of, the handheld device 400 vibrating to indicate which ones, if any, of the player selectable elements 610 are associated with awards, the handheld device 400 can emit light, using the light 408*b* (FIG. 4), and/or play a prerecorded audio clip (e.g., beeping, etc.), using the audio speakers 408*c* (FIG. 4), when hovering over (e.g., positioned adjacent to) a player selectable element 610 associated with an award, thus, indicating to the player that the adjacent player selectable element 610 (the one being hovered over) should be selected as it is associated with an award (e.g., credits).

The hovering feature of the gaming system 600 using the handheld device 400 during play of the bonus game can be limited in one or more ways. For example, an amount of time that a player can use the hovering feature during play of the bonus game can be limited (e.g., 2 seconds, 5 seconds, twenty seconds), which can encourage faster play of the bonus game. The amount of time that a player can use the hovering feature while playing the bonus game can be based on factors determined during play of the basic wagering game, such as, for example, rate of play, rate of coin-in, total play time, max bet being used, etc. Further, information indicated to the player using the hovering feature can be limited. For example, the hover feature might only indicate that an award is close to an area being hovered over without specifying a specific player selectable element (e.g., the hovering feature has a low resolution). In some implementations, the resolution of the hovering feature can be adjusted based on factors determined during play of the basic wagering game, such as, for example, rate of play, rate of coin-in, total play time, max bet being used, etc. That is, in some implementations, the hovering feature has a maximum resolution (e.g., indicates specific player selectable elements as being associated with maximum awards) only when the player is placing the maximum wagers during play of the basic wagering game.

Referring generally to FIG. 6A, the gaming system 500 can be setup to monitor the position of the handheld devices 400*a,b* during play of the wagering game on the first and the second gaming terminals 10*a,b* and/or when play has concluded on one or both of the gaming terminals 10*a,b*. In some such implementations, the gaming system 500, via for example the processor 30, can cause at least one of the display devices 12, 14 to display an indication (e.g., "Return the Remote to the Dock") to return the handheld device 400 to the docking station 510. Such a "Return the Remote" indication can be displayed after the player presses a cash-out button. For another example, such a "Return the Remote" indication can be displayed upon conclusion of the bonus game (e.g., after using the handheld device 400 to find awards in a picking bonus game, such as the one described in reference to FIGS. 8A-8C herein). In some alternative implementations, the gaming system 500, 600 can be setup to only dispense and/or print a cash-out ticket (e.g., a barcoded ticket indicative of the player's remaining credits that is redeemable for cash) if the player responds to the "Return the Remote" indication by placing the handheld device 400 back into the docking station 510 and/or within the base volumetric space 540.

While the docking station 510 for the handheld devices 400 is shown and described herein as being part of the spacer 502, in some alternative implementations, the docking station can be incorporated in one or both of the chairs 515*a,b* (not shown). For example, the docking station 510 can be incorporated into one or more armrests of one or more of the chairs 515*a,b* positioned in front of the gaming terminals 10*a,b*. A volumetric space around one or more of the armrests of one or more of the chairs 515*a,b* can define additional predefined and/or configurable zones in which inputs made using the handheld device 400 therein result in one or more functions being performed by the gaming system 500, 600 that are the same as, or different from, functions performed by the gaming system 500, 600 when the same input is made with the handheld device 400 being located within a different zone (e.g., the base predefined zone defined by the base volumetric space 540.

In some implementations of the present disclosure, the light(s) 408*b* (FIGS. 4 and 5) included in the handheld device 400 can blink according to a first lighting pattern when the handheld device 400 is positioned within a first zone (e.g., the base predefined zone defined by at least a portion of the base volumetric space 540) and blink according to a second lighting pattern distinct from the first lighting pattern when the handheld device 400 is positioned within a second zone (e.g., the first predefined zone defined by at least a portion of the first volumetric space 520). Such variation of light blinking can aid in indicating to the player that the handheld device 400 is positioned in the wrong zone for playing the portion of the wagering game being displayed on the display devices 12, 14 of the gaming terminal 10. For example, if the handheld device 400 is currently positioned in the base predefined zone defined by the base volumetric space 540 (e.g., the handheld device 400 is docked), but the handheld device 400 can be used to enhance play of the bonus game being conducted by the gaming terminal 10, the light(s) 408*b* can blink rapidly to aid in indicating to the player that the player should remove the handheld device 400 and use it in the first predefined zone defined by the first volumetric space 520 (e.g., in the same, or similar, manner described in reference to FIGS. 8A-8C). Further, for another example, if the handheld device 400 is currently dangling or dropped near a floor (not shown) supporting the gaming terminal 10, but the handheld device 400 should be in the docking station 510 (e.g., so the handheld device 400 can be charged and/or be used for playing the wagering game), the light(s) 408*b* can blink rapidly to aid in indicating to the player that the player should pick the handheld device 400 off the floor and replace it in the docking station 510. In addition to, or in lieu of, blinking the light(s) 408*b*, the haptic feedback device 408*a* and/or the audio speakers 408*c* can be used for the same, or similar, purpose (e.g., to indicate that the handheld device 400 should be moved for use in a different zone, to indicate that the remote is dangling or dropped near the floor, etc.). Further, in some implementations, an animation (e.g., a video) can be displayed on one or more of the display devices 12, 14 and/or a community display device of the gaming system 500, 600 indicating that the handheld device 400 should be picked up and placed in, for example, the docking station 510.

While the handheld device 400 of the present disclosure have been described as being used separately with one or both of the gaming terminals 10*a,b*, in some alternative implementations, two of the handheld devices 400 can be coupled together (not shown) for use in playing the wagering game. For example, in some such alternative implementations, combining two handheld devices 400 into one device (not shown) transforms the two handheld devices 400 into a new device that is capable of causing special and/or different functions to occur. One such special function includes shooting targets. Pressing the button 420 on one of the coupled handheld device 400 can act as the weapon trigger whereas the other button 420 can act as a weapon selector (e.g., switches between weapons.

As described above, the handheld devices 400 can be used to make gestures that are used as inputs into the gaming system 500. In some implementations, a player or players of the wagering system 500 can teach the gaming system gestures and the learnt gestures can be automatically and/or selectively by the player(s) assigned to execute one or more functions. Further, the gaming system 500 can capture representations of gestures (e.g., heat maps of gestures, 2D and/or 3D digital models of gestures, etc.) made by players of the wagering game over time and refine a gesture library stored in memory. That is, the gaming system 500 and/or the external system 48 (FIGS. 2 and 4) can analyze gestures made by players and adjust what is considered a specific gesture (e.g., what the gaming system 500 accepts as the specific gesture).

As described above, the same input in two different zones can result in the same and/or different function being conducted by the gaming system 500, 600. For example, in a gaming system similar to the gaming system 500 including a community display device, the same input (e.g., a press of the button 420), made by two players of different gaming terminals 10 using respective handheld devices 400 in two different zones can result in two different effects (e.g., graphics) being displayed on the community display device.

In yet another example, moving between zones can not only result in a different function being conducted by the gaming system 500, 600 in response to the same input (e.g., a press of the button 420), but also the mere act of moving a handheld device 400 from one zone to another. In one implementation, the gaming system 500, 600 includes a multi-player battle mode where one or more competitors compete against each other and/or virtual opponents in a first-person-shooter event having avatars representing the one or more players.

In one implementation, a first predefined zone may be located relatively higher than a second predefined zone. When the handheld device 400 is held in the first zone, the player's avatar displays a rocket launcher on its shoulder. If the button 420 is depressed while the handheld device is in the first zone, the avatar fires a single rocket from the launcher. As the player moves the handheld device 400 from the first predefined zone to the second predefined zone (e.g., lowers the handheld device 400), the player's avatar may holster its rocket launcher and begin carrying a machine gun or other weapon immediately upon the handheld device 400 crossing from the first to the second predefined zone. If the button 420 is depressed while the handheld device is in the second zone, the machine gun may begin to continuously fire until the button is released. In this manner, not only is the resultant function of the same type of player input (e.g., button press) different between the two predefined zones, but the mere transition of the input device (e.g., handheld device 400) from one zone to the other causes a visual change representing that movement.

Some implementations of the handheld devices 400 of the present disclosure have been described as including one or more audio speakers 408*c*. In some such implementations, a volume of the audio speakers 408*c* can change (e.g., increase or decrease) depending on the position and/or the orientation of the handheld device 400 relative to the gaming terminal 10 and/or the spacer 502. For example, the volume of the audio speaker 408*c* can increase in response to the handheld device 400 being moved relatively further from the primary display device 12. Similarly, volume of audio speakers built into the gaming terminal 10 can vary based on the position and/or the orientation of the handheld device 400 relative to the gaming terminal 10 and/or the spacer 502.

Further, in some such implementations including one or more audio speakers 408*c*, the sound or sound track played over the audio speakers 408*c* can change (e.g., from a first track to a second track) depending on the position and/or the orientation of the handheld device 400 relative to the gaming terminal 10 and/or the spacer 502. For example, a first sound track associated with a first graphical element on the right portion of the primary display 12 can be played when the handheld device 400 is positioned toward and/or adjacent to the right side of the primary display device 12 and a second sound track (e.g., different from the first sound track) associated with a second graphical element (e.g., different from the first graphical element) on the left portion of the primary display 12 can be played when the handheld device 400 is positioned toward and/or adjacent to the left side of the primary display device 12.

As described herein, the functions performed by the gaming system 500, 600 can vary depending on the input (e.g., press of the button 420, making of a gesture, etc.) and in what zone (e.g., the base predefined zone, the first predefined zone, the second predefined zone, the first zone 525, etc.) the handheld device 400 is located when the input is made. In addition thereto, or in lieu thereof, the functions performed by the gaming system 500, 600 can vary depending on a state of a separate piece of hardware, such as, for example, a state of the chair 515*a,b*. For example, the state of the chair 515*a,b* can switch between upright and reclined. Thus, in some alternative implementations, pressing the button 420 with the chair 515*a* in the upright state causes the gaming system 500 to perform a first function and pressing the button 420 with the chair 515*a* in the reclining state causes the gaming system 500 to perform a second function, where the first and the second functions are the same or different.

Further, as described herein, the functions performed by the gaming system 500, 600 can vary depending on the input (e.g., press of the button 420, making of a gesture, etc.) and in what zone (e.g., the base predefined zone, the first predefined zone, the second predefined zone, the first zone 525, etc.) the handheld device 400 is located when the input is made. In addition thereto, or in lieu thereof, the functions performed by the gaming system 500, 600 can vary depending on in which hand (e.g., left hand or right hand) a player holds the handheld device 400. For example, if the player is holding the handheld device 400 in the player's right hand, a virtual deck of cards displayed on the primary display device (e.g., used in conducting the wagering game) is displayed on the right portion of the display device 12, whereas if the player switches the handheld device 400 to the player's left hand, the virtual deck of cards is switched and displayed on the left portion of the display device 12. Thus, in some alternative implementations, pressing the button 420 with the handheld device 400 in the right hand of the player causes the gaming system 500 to perform a first function and pressing the button 420 with the handheld device 400 in the left hand of the player causes the gaming system 500 to perform a second function, where the first and the second functions are the same or different. The gaming system 500, 600 can be configured to determine which hand of the player is holding the handheld device 400 by determining, for example, which side (e.g., left side or right side) of the zone the handheld device 400 is positioned (e.g., using the position and/or orientation sensor 418, the processor 30, etc.). Additionally, or in lieu thereof, the gaming system 500, 600 can be configured to determine which hand of the player is holding the handheld device 400 using one or more heat sensors (e.g., thermal camera) and/or other video processing means (e.g., standard video camera, still camera, IR camera, UV camera, thermal camera, etc.) to identify a skeleton and/or an outline of the player and associate the handheld device 400 with one or more portions of the skeleton and/or the outline of the player for use in determining which hand is holding the handheld device 400.

Each of these implementations and obvious variations thereof is contemplated as falling within the spirit and scope of the claimed invention, which is set forth in the following claims. Moreover, the present implementations and/or concepts expressly include any and all combinations and subcombinations of the preceding elements and aspects.

What is claimed is:

1. A gaming system, comprising:

a fixed structure including a docking station;

a gaming terminal including (i) a cabinet, (ii) one or more display devices positioned adjacent to the fixed structure, and (iii) one or more electronic input devices including a first input device configured to detect a physical item associated with a monetary value that establishes a credit balance and a second input device configured to receive a cashout input that initiates a payout from the credit balance;

one or more processors;

a handheld device coupled to the fixed structure via a cable and being receivable in the docking station, the handheld device being positionable in a first predefined zone and a base predefined zone with respect to the fixed structure, the first predefined zone being defined as a first volumetric space generally in front of the one or more display devices, the base predefined zone being defined as a base volumetric space generally in front of the fixed structure distinct from the first predefined zone;

one or more sensors configured to detect a position of the handheld device relative to the first predefined zone and the base predefined zone; and a memory device storing instructions that, when executed by at least one of the one or more processors cause the gaming system to, detect a first input from the handheld device, perform a first function in response to the first input being detected while the one or more sensors detect that the handheld device is positioned in the first predefined zone, the first function including causing the gaming system to select a selectable element during play of a bonus game of a wagering game, and perform a second function in response to the first input being detected while the one or more sensors detect that the handheld device is positioned in the base predefined zone, the second function being different from the first function, the second function including causing the gaming system to conduct a play of a basic game of the wagering game and display a randomly selected outcome of the basic game on the one or more display devices.

2. The gaming system of claim 1, wherein the one or more sensors are configured to sense movement of the handheld device in the first volumetric space generally in front of the one or more display devices, and the first input includes the handheld device being moved generally according to a first gesture in the first predefined zone.

3. The gaming system of claim 2, wherein the first gesture includes moving the handheld device in an up-down movement relative to the fixed structure, a side-to-side movement relative to the fixed structure, or a combination of both.

4. The gaming system of claim 1, wherein the one or more sensors are disposed in the handheld device and include an inertial sensor, an optical sensor, a magnetic sensor, or any combinations thereof, the orientation of the handheld device being detected by the one or more sensors and communicated to at least one of the one or more processors of the gaming system.

5. The gaming system of claim 1, wherein the handheld device includes a button coupled to the one or more sensors and the first input includes a press of the button.

6. The gaming system of claim 1, wherein the gaming system is configured to detect and accept inputs, using at least one of the one or more sensors, in the base predefined zone during play of the basic game and to detect and ignore inputs in the first predefined zone during play of the basic game, and wherein the gaming system is configured to detect and accept inputs, using at least one of the one or more sensors, in the first predefined zone during play of the bonus game and to detect and ignore inputs in the base predefined zone during play of the bonus game.

7. The gaming system of claim 1, wherein the handheld device is configured to be used in the base predefined zone during play of the basic game, and wherein the handheld device is configured to be used in the first predefined zone during play of the bonus game.

8. The gaming system of claim 7, wherein at least one of the one or more processors is configured to cause at least one of the one or more display devices to display an indication to return the handheld device to the base predefined zone in response to the play of the bonus game concluding.

9. The gaming system of claim 1, wherein the handheld device further includes a light, the light being configured to blink according to a first lighting pattern in response to the handheld device being positioned within the first predefined zone and being configured to blink according to a second lighting pattern distinct from the first lighting pattern in response to the handheld device being positioned within the base predefined zone.

10. The gaming system of claim 1, wherein the handheld device further includes a haptic feedback device that is configured to vibrate according to a first vibration pattern in response to the handheld device being positioned within the first predefined zone and configured to vibrate according to a second vibration pattern distinct from the first vibration pattern in response to the handheld device being positioned within the base predefined zone.

11. The gaming system of claim 1, wherein the handheld device further includes a speaker, the speaker being configured to play a first audio clip in response to the handheld device being positioned within the first predefined zone and being configured to play a second audio clip distinct from the first audio clip in response to the handheld device being positioned within the base predefined zone.

12. A gaming system, comprising:

a gaming terminal including a cabinet that houses one or more display devices and one or more electronic input devices, the one or more electronic input devices including a first input device configured to detect a physical item associated with a monetary value that establishes a credit balance and a second input device configured to receive a cashout input that initiates a payout from the credit balance;

a fixed structure, wherein the fixed structure is a spacer adjacent to the cabinet of the gaming terminal, the spacer having a housing that is distinct from the cabinet of the gaming terminal;

one or more processors;

a handheld device coupled to the fixed structure via a cable, the handheld device being positionable in a first predefined zone and a base predefined zone with respect to the fixed structure, the first predefined zone being defined as a first volumetric space generally in front of the one or more display devices, the base predefined zone being defined as a base volumetric space generally in front of the fixed structure distinct from the first predefined zone;

one or more sensors configured to detect a position of the handheld device relative to the first predefined zone and the base predefined zone; and a memory device storing instructions that, when executed by at least one of the one or more processors cause the gaming system to, detect a input from the handheld device, perform a first function in response to the input being detected while the one or more sensors detect that the handheld device is positioned in the first predefined zone, the first function including causing the gaming system to select a selectable element during play of a bonus game of the wagering game, and perform a second function in response to the input being detected while the one or more sensors detect that the handheld device is positioned in the base predefined zone, the second function being different from the first function, the second function including causing the gaming system to conduct a play of a basic game of the wagering game and display a randomly selected outcome of the basic game on the one or more display devices.

13. A community gaming system, comprising:

a first gaming terminal including (i) one or more first display devices for displaying plays of a wagering game and (ii) one or more electronic input devices including a first input device configured to detect a physical item associated with a monetary value that establishes a credit balance and a second input device configured to receive a cashout input that initiates a payout from the credit balance;

a second gaming terminal adjacent to the first gaming terminal, the second gaming terminal including one or more second display devices displaying plays of the wagering game;

a fixed structure positioned between the first and the second gaming terminals, the fixture structure including a docking station;

a first handheld device coupled to the fixed structure via a first cable and being receivable in the docking station, the first handheld device being positionable in a first predefined zone and a base predefined zone, the first predefined zone being defined as a first volumetric space generally in front of the one or more first display devices, the base predefined zone being defined as a base volumetric space generally in front of the fixed structure distinct from the first predefined zone, the first handheld device being configured to be calibrated for use in playing the wagering game on the first gaming terminal or on the second gaming terminal;

a second handheld device coupled to the fixed structure via a second cable, the second handheld device being positionable in a second predefined zone and the base predefined zone, the second predefined zone being defined as a second volumetric space generally in front of the one or more second display devices distinct from the first and the base predefined zones, the second handheld device being configured to be calibrated for use in playing the wagering game on the other of the first gaming terminal and the second gaming terminal; and a plurality of sensors configured to detect positions of the first and second handheld devices relative to the base predefined zone, the first predefined zone, and the second predefined zone.

14. The community gaming system of claim 13, wherein the first handheld device is configured to be calibrated for use in conducting the wagering game on the first gaming terminal in response to (i) the first handheld device being positioned in the base predefined zone and at least one of the plurality of sensors detecting a first input and (ii) the first handheld device being positioned in the first predefined zone and at least one of the plurality of sensors detecting a second input.

15. The community gaming system of 14, wherein the detected second input is the same as the detected first input.

16. The community gaming system of claim 14, wherein the second handheld device is configured to be calibrated for use in conducting the wagering game on the second gaming terminal in response to (i) the second handheld device being positioned in the base predefined zone and at least one of the plurality of sensors detecting a third input and (ii) the second handheld device being positioned in the second predefined zone and at least one of the plurality of sensors detecting a fourth input.

17. The community gaming system of claim 13, wherein in response to the first handheld device being calibrated for use in conducting the wagering game on the first gaming terminal, the second handheld device is configured to be calibrated for use in conducting the wagering game only on the second gaming terminal.

18. A gaming system, comprising:

a gaming terminal including (i) a cabinet, (ii) a display device, and (iii) one or more electronic input devices including a first input device configured to detect a physical item associated with a monetary value that establishes a credit balance and a second input device configured to receive a cashout input that initiates a payout from the credit balance;

a fixed structure positioned adjacent to the gaming terminal;

one or more processors;

a handheld device coupled to the fixed structure via a cable, the handheld device being moveable in a predefined zone of a volumetric space adjacent to the display device;

one or more sensors configured to detect a position of the handheld device relative to the predefined zone; and a memory device storing instructions that, when executed by at least one of the one or more processors cause the gaming system to, display, on display device, at least a portion of a wagering game including a plurality of selectable bonus elements, perform a first function in response to the one or more sensors detecting that the handheld device is positioned in the predefined zone and adjacent to a first one of the plurality of selectable bonus elements, wherein the handheld device performing the first function indicates that the first one of the plurality of selectable bonus elements is associated with a first award having a first amount of credits, and perform a second function, which is distinct from the first function, in response to the one or more sensors detecting that the handheld device is positioned in the predefined zone and adjacent to a second one of the plurality of selectable bonus elements, wherein the handheld device performing the second function indicates that the second one of the plurality of selectable bonus elements is associated with a second award having a second amount of credits that is greater than the first amount of credits.

19. The gaming system of claim 18, wherein the first function includes the handheld device vibrating at a first frequency and wherein the second function includes the handheld device vibrating at a second frequency distinct from the first frequency.

20. The gaming system of claim 19, wherein the first frequency is zero.

21. The gaming system of claim 18, wherein the first amount of credits.

22. The gaming system of claim 18, wherein the fixed structure is separate and distinct from the cabinet and the fixed structure is positioned adjacent to the cabinet.

* * * * *